US008042638B2

(12) United States Patent
Tanaka

(10) Patent No.: US 8,042,638 B2
(45) Date of Patent: Oct. 25, 2011

(54) ROTARY WORKING MACHINE

(75) Inventor: Katashi Tanaka, Fukuoka (JP)

(73) Assignee: Yanmar Co., Ltd., Osaka (JP)

( * ) Notice: Subject to any disclaimer, the term of this patent is extended or adjusted under 35 U.S.C. 154(b) by 311 days.

(21) Appl. No.: 11/994,627

(22) PCT Filed: Jan. 19, 2006

(86) PCT No.: PCT/JP2006/300738

§ 371 (c)(1),
(2), (4) Date: May 6, 2008

(87) PCT Pub. No.: WO2007/004332

PCT Pub. Date: Jan. 11, 2007

(65) Prior Publication Data

US 2009/0226288 A1 Sep. 10, 2009

(30) Foreign Application Priority Data

Jul. 5, 2005 (JP) ..... 2005-196833

(51) Int. Cl.
*B62D 33/063* (2006.01)
*B62D 33/073* (2006.01)

(52) U.S. Cl. ..... 180/89.12; 180/326

(58) Field of Classification Search ..... 180/89.1, 180/89.13, 90.6, 315, 326, 327, 89.12
See application file for complete search history.

(56) References Cited

U.S. PATENT DOCUMENTS 1,795,106 A * 3/1931 Caesar ..... 180/89.1
3,319,487 A * 5/1967 Roberts et al. ..... 74/560
3,831,704 A * 8/1974 Zuege ..... 180/89.1
4,126,202 A * 11/1978 Hern ..... 180/89.12
4,548,093 A * 10/1985 Nomura et al. ..... 74/512
6,170,588 B1 * 1/2001 Irino et al. ..... 180/89.12
6,244,369 B1 * 6/2001 Yunoue et al. ..... 180/89.12
6,990,757 B2 * 1/2006 Takemura et al. ..... 37/347
7,320,380 B2 * 1/2008 Ueda et al. ..... 180/327
7,481,289 B2 * 1/2009 Ueda et al. ..... 180/89.16
7,530,418 B2 * 5/2009 Ishii et al. ..... 180/89.12

(Continued)

FOREIGN PATENT DOCUMENTS

EP 1 061 186 12/2000

(Continued)

OTHER PUBLICATIONS

International Search Report mailed on Mar. 14, 2006 for International Application No. PCT/JP2006/300738 filed on Jan. 19, 2006, 1 pg.

(Continued)

*Primary Examiner* — Paul N. Dickson
*Assistant Examiner* — Barry Gooden, Jr.
(74) *Attorney, Agent, or Firm* — Sterne, Kessler, Goldstein & Fox P.L.L.C.

(57) ABSTRACT

Ample spaces are secured on a rotating table frame, in front of and behind a control valve. A rotary working machine where a step is placed on a rotating table frame, at the front of the frame, and a control valve is placed below the step. The step has operation levers and pedals mounted on it. The control valve is connected to the operation levers and the pedals to perform drive control of a hydraulic actuator, and is placed at an incline so as to be high at the front and low at the rear.

2 Claims, 26 Drawing Sheets

U.S. PATENT DOCUMENTS

| | | | | |
|---|---|---|---|---|
| 7,798,292 | B2 * | 9/2010 | Nunez | 188/16 |
| 7,857,083 | B2 * | 12/2010 | Oyamada et al. | 180/89.1 |
| 7,900,730 | B2 * | 3/2011 | Hokimoto | 180/89.1 |
| 2003/0154635 | A1 | 8/2003 | Yukawa et al. | |
| 2004/0149462 | A1 * | 8/2004 | Okamoto et al. | 172/292 |
| 2005/0210718 | A1 * | 9/2005 | Ueda et al. | 37/466 |
| 2006/0080930 | A1 * | 4/2006 | Brindle | 52/655.1 |
| 2006/0144634 | A1 * | 7/2006 | Portscheller et al. | 180/330 |
| 2006/0266573 | A1 * | 11/2006 | Ishii et al. | 180/326 |
| 2007/0068722 | A1 * | 3/2007 | Miyake | 180/327 |
| 2009/0104011 | A1 * | 4/2009 | Oyamada et al. | 414/719 |

FOREIGN PATENT DOCUMENTS

| | | |
|---|---|---|
| GB | 2 204 558 | 11/1988 |
| JP | 5-89553 | 12/1993 |
| JP | 2001-107390 | 4/2001 |
| JP | 2003-020683 | 1/2003 |
| JP | 2004 142484 | 5/2004 |

OTHER PUBLICATIONS

Supplemental European Search Report for EP Appl. No. 0671984, mailed Nov. 10, 2009, 2 pgs.

* cited by examiner

ROTARY WORKING MACHINE

TECHNICAL FIELD

The present invention relates to rotary working machines of rear ultraminiature rotary type and ultraminiature rotary type, in particular, to an arrangement structure of a rotating table frame.

BACKGROUND ART

Conventionally, in a rotary working machine such as power shovel, a rotating table frame is generally arranged on a traveling device, a working machine including a boom and arm and an attachment such as a bucket is attached to the front part of the rotating table frame, and an engine, a counter weight, and the like are arranged at the rear part of the rotating table frame. A step provided with an operation lever for hydraulic actuator operation, an operation pedal, and the like is arranged at the front part of the rotating table frame, and a control valve connected to the operation pedal and the like at the lower side of the step to perform drive control of the hydraulic actuator is arranged horizontally (see e.g., Patent Document 1).

However, in the rotary working machine as in the prior art, since the control valve is arranged on the rotating table frame in a horizontal state, the space at the front and the back of the control valve becomes narrow, and such portion cannot be effectively used. The distance between the control valve and the operation lever or the operation pedal becomes long, and the link mechanism for connecting the same has a complex configuration, whereby a great number of components are required and reduction in cost is difficult to achieve.

Japanese Laid-Open Patent Publication No. 2003-20683

DISCLOSURE OF THE INVENTION

Problem to be Solved by the Invention

The problem to be solved is to ensure a wide space on the front side and the back side of the control valve on the rotating table frame.

Means for Solving the Problem

A rotary working machine of the present invention relates to a rotary working machine in which a step provided with an operation lever and a pedal is arranged at the front part of a rotating table frame in front of a driver's seat, and a control valve is connected to the operation level and the pedal at the lower side of the step to perform the drive control of a hydraulic actuator; wherein the control valve is placed inclined so as to be high at the front and low at the rear.

In the rotary working machine, a reservoir tank is arranged on the rear side of the control valve.

Effects of the Invention

In the rotary working machine, since the control valve is placed inclined so as to be high at the front and low at the rear in the rotary working machine in which a step provided with an operation lever and a pedal is arranged at the front part of a rotating table frame in front of a driver's seat, and a control valve is connected to the operation level and the pedal at the lower side of the step to perform the drive control of a hydraulic pedal at the lower side of the step to perform the drive control of a hydraulic actuator, a space can be enlarged at the front and the back side of the control valve, and in particular, external take-out components such as a breaker can be arranged in a space on the front side of the control valve. Furthermore, the distance between the upper end of the control valve and the pedal or the level is reduced, so that the link mechanism for connecting the same has a short and simple configuration, and the cost can be reduced.

In the rotary working machine of the present invention, the capacity of the reservoir tank is greatly ensured since the reservoir tank is arranged on the rear side of the control valve.

DETAILED DESCRIPTION OF THE INVENTION

Figure 1:
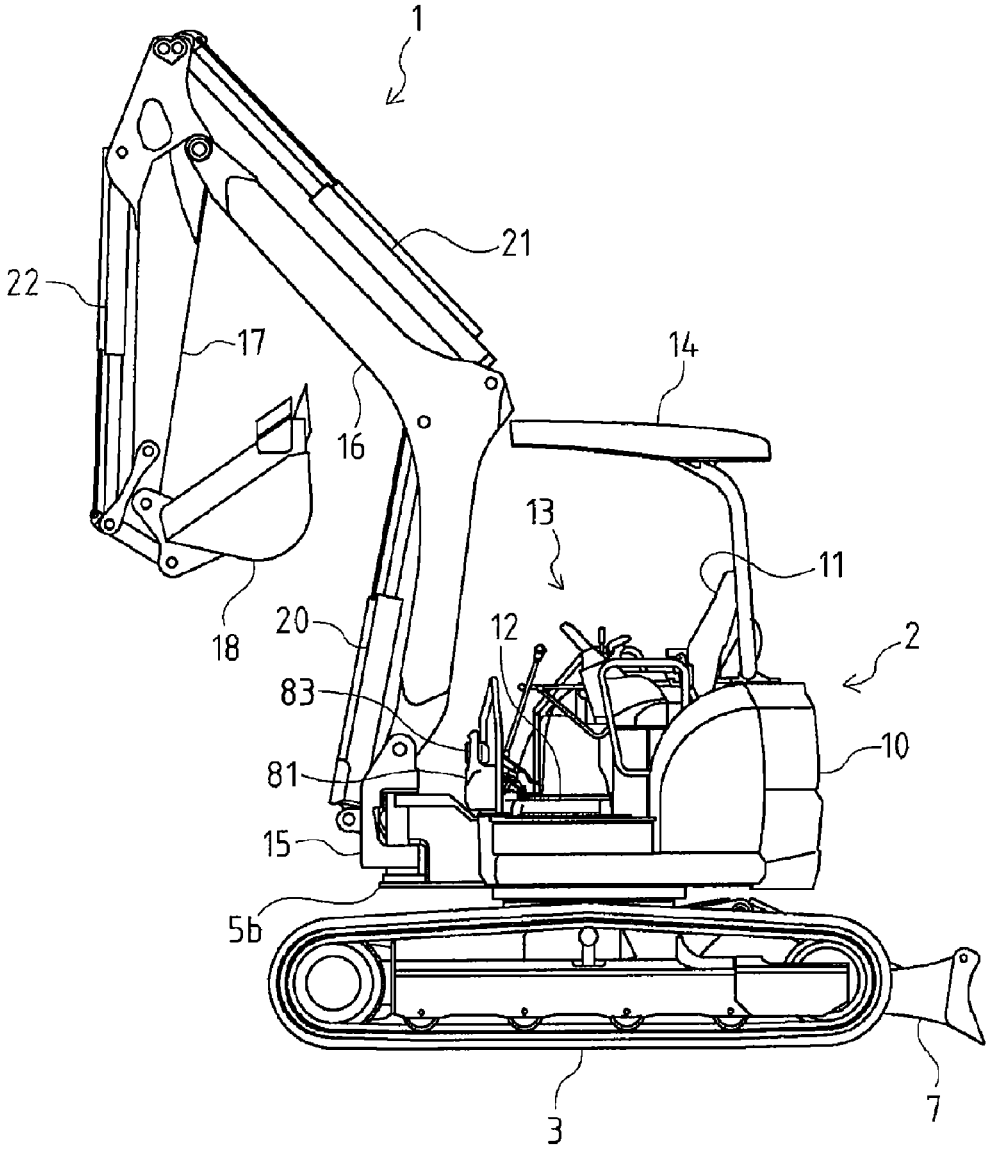
FIG. 1 is a left side view of a rear ultraminiature rotary type rotary working machine according to one example of the present invention.
Figure 2:
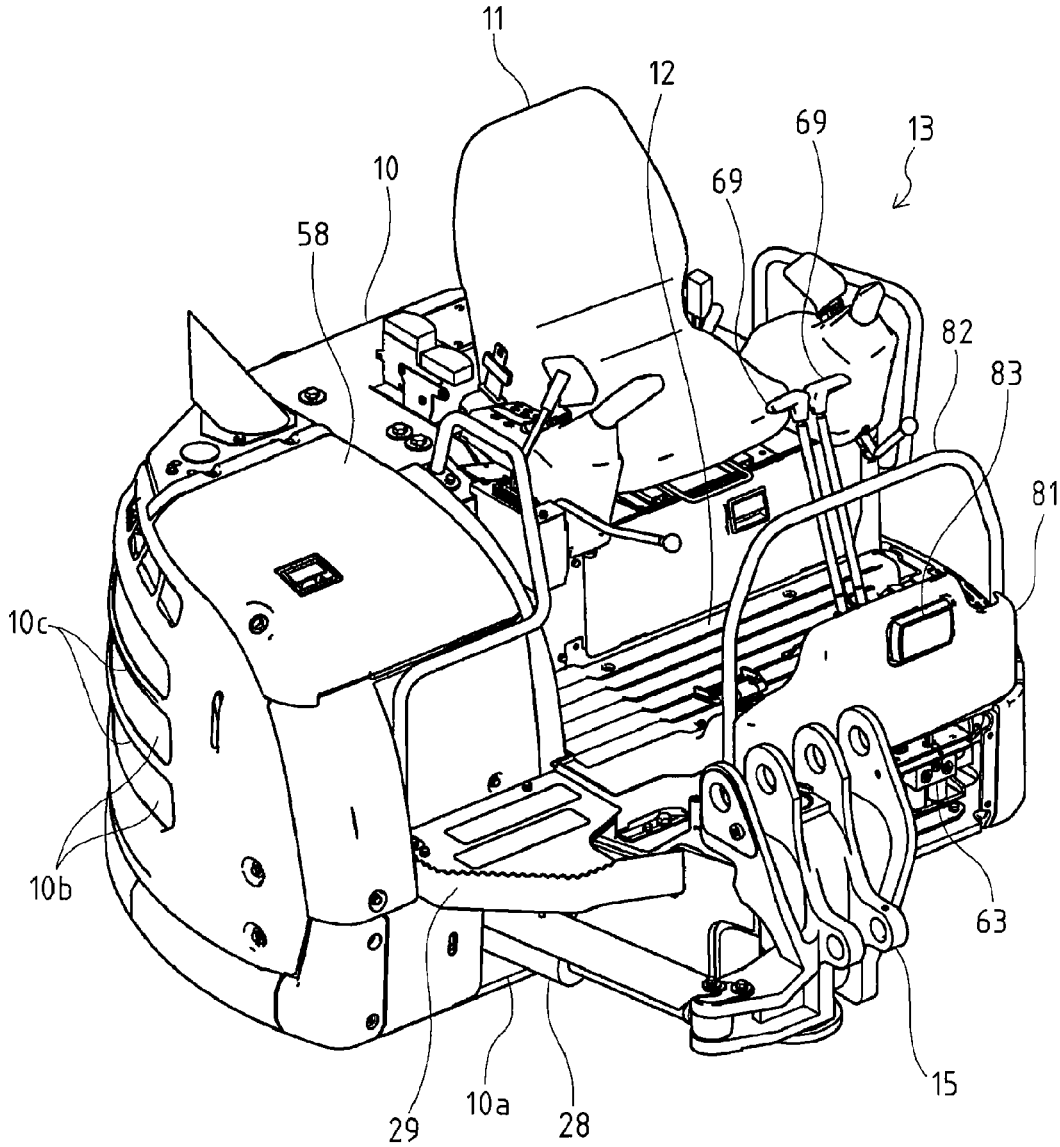
FIG. 2 is a perspective view of a main equipment of the rotary working machine.
Figure 3:
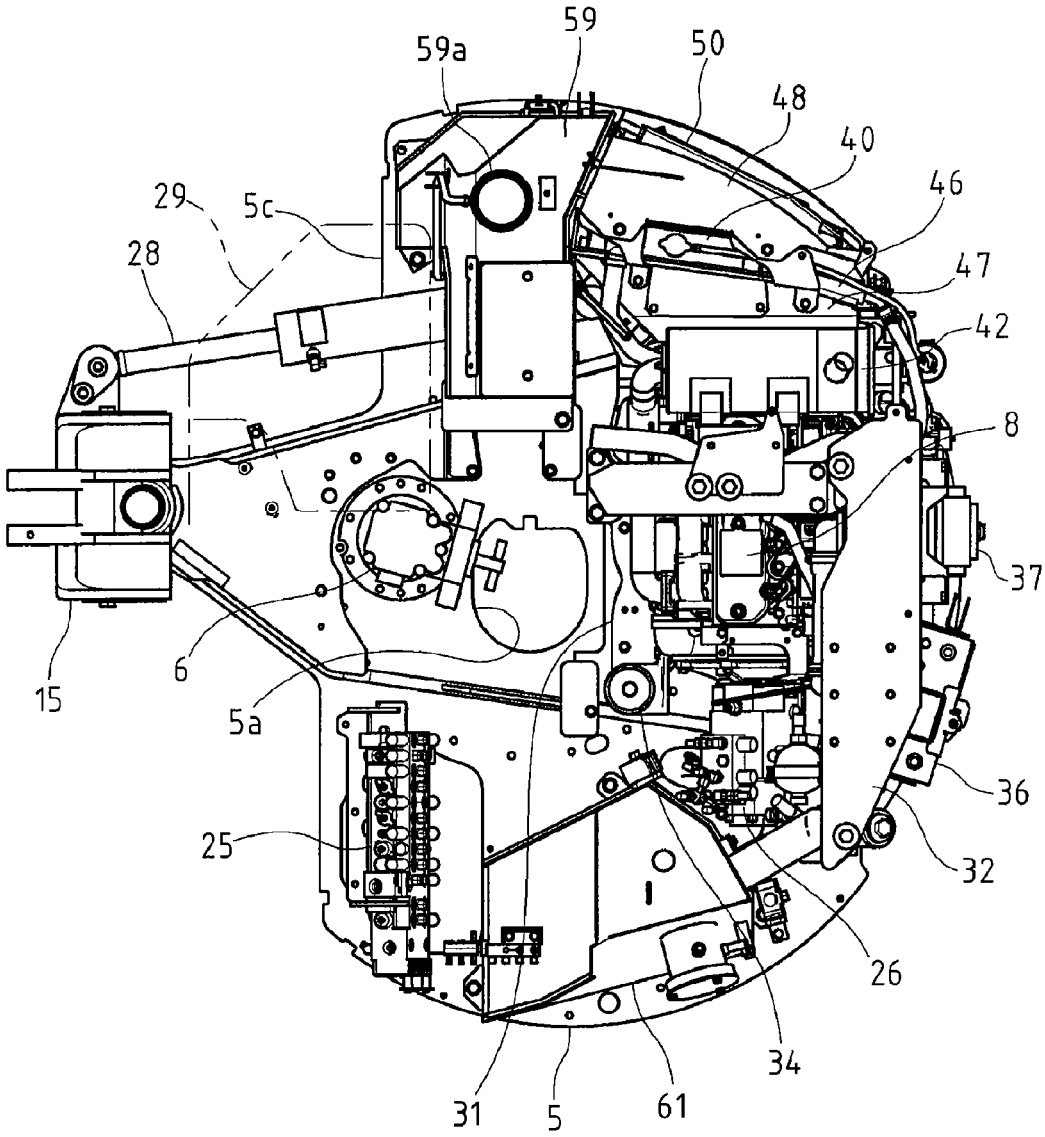
FIG. 3 is a plan view showing an arrangement structure of a rotation table frame.
Figure 4:
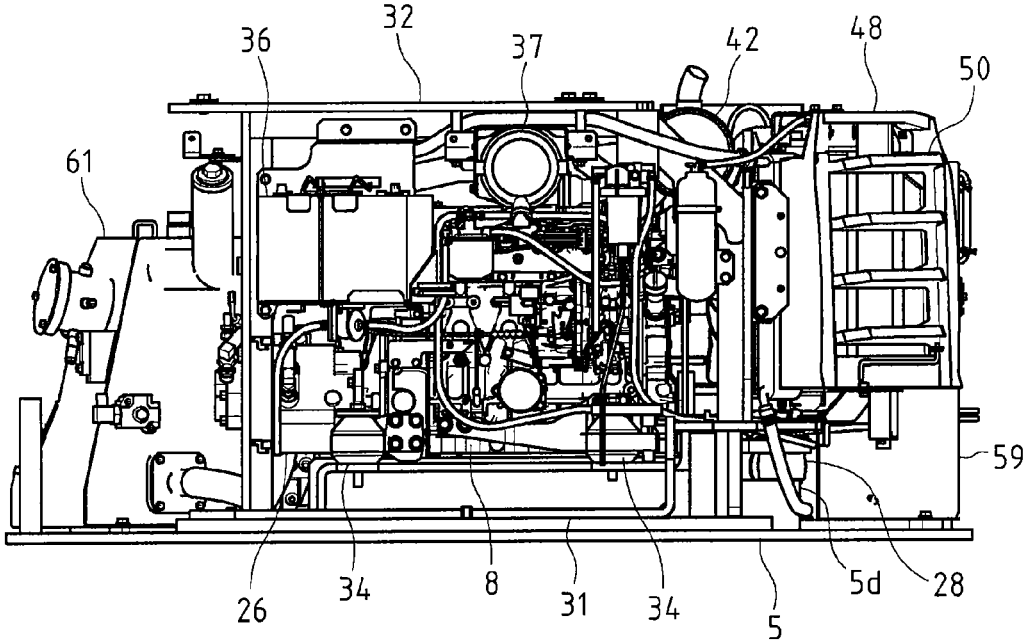
FIG. 4 is a rear view showing an arrangement structure of the rotation table frame.
Figure 5:
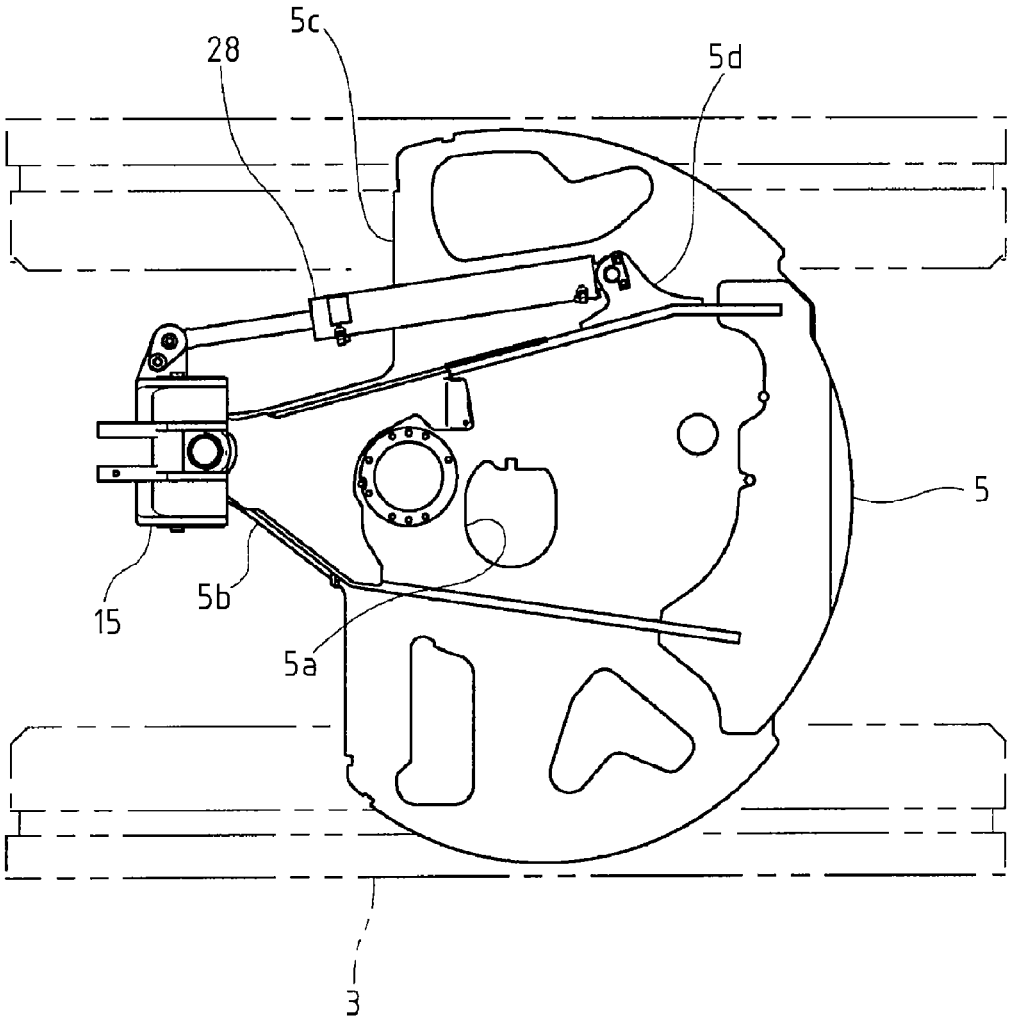
FIG. 5 is a plan view of the rotation table frame.
Figure 6:
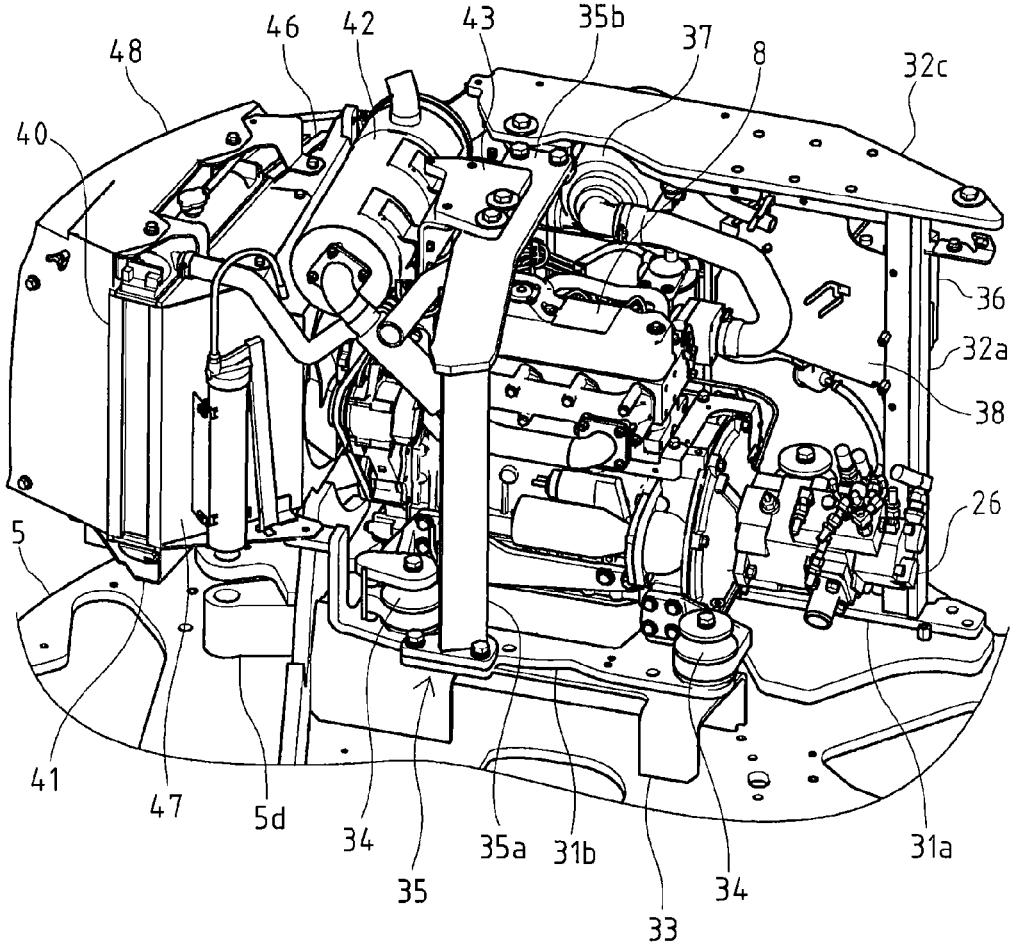
FIG. 6 is a front perspective view of an engine supporting part.

As shown in FIG. 1, FIG. 2, and FIG. 3, in a rear ultraminiature rotary type power shovel in which a rotary working machine such as working machine 1 is attached at the middle in the left and right direction of the front part of a main equipment 2, a rotation table frame 5 is supported in a left and right rotatable manner by way of a rotary base bearing at the middle of the upper part of a crawler traveling device 3, and a rotary motor 6 is arranged on the rotation table frame 5. A blade 7 is arranged in a freely up and down turning manner on either the front or the rear side of the crawler traveling device 3. A bonnet 10 for covering an engine 8 etc. is arranged on the upper part of the rotation table frame 5, and a driver's seat 11 is arranged on the bonnet 10 or on the front side of the bonnet 10. An operation lever, a lock lever, and the like are arranged near the driver's seat 11, and a travel lever and a pedal are arranged on a step 12 on the front side of the driver's seat 11 thereby configuring a drive operation unit 13. A canopy 14 or a cabin is arranged above the drive operation unit 13.

A boom bracket 15 is attached in a left and right turning manner at the middle in the left and right direction of the front end of the rotation table frame 5, and a lower end of a boom 16 is supported in the up and down (front and back) turning manner by the boom bracket 15. The boom 16 is bent towards the front side at the middle to be formed to a substantially dogleg shape in side view. A rear end of an arm 17 is supported in a front and back turning manner at the upper end of the boom 16, and a bucket 18 which is a work attachment, is supported in a freely front and back turning manner at the front end of the arm 17. A boom turning boom cylinder 20 is interposed between the front part of the boom bracket 15 and the front part of the middle part of the boom 16, an arm turning arm cylinder 21 is interposed between a rear surface of the middle part of the boom 16 and a stay arranged at the rear end of the arm 17, and a bucket turning bucket cylinder 22 is interposed between the stay at the rear part of the arm 17 and the bucket 18. The boom 16, the arm 17, the bucket 18, and each cylinder 21, 22, 23 configure the working machine 1.

In the working machine 1, the boom 16 can be turned by an extension drive of the boom cylinder 20, the arm 17 can be turned by an extension drive of the arm cylinder 21, and the bucket 18 can be turned by an extension drive of the bucket cylinder 22. In the main equipment 2, the rotation table frame 5 on the crawler traveling device 3 is rotatable by the rotation drive of the rotary motor 6. The cylinders 21, 22, 23, which are hydraulic actuators, and the rotary motor 6 are configured so as to be driven by supply of pressure oil through a hydraulic hose from a hydraulic pump 26 arranged on the rotation table frame 5 when a control valve 25 is switched through a turning operation of the operation lever, pedal, or the like arranged on the drive operation unit 13.

As shown in FIG. 2 to FIG. 5, an opening 5*a* for arranging a rotary base bearing is formed at the middle in the front and back, and left and right directions of the rotation table frame 5, where the center serves as the center of rotation of the main equipment 2. The rear part of the rotation table frame 5 is formed so that an outer peripheral shape has a semicircular (substantially 3/5 circle) shape with the center of rotation as the center in plan view, where the radius of the semicircular portion is substantially the same as the radius of the rotation trajectory of the rear end of the rotation table frame 5. In other words, the distance from the center of rotation to the circular arc portion is assumed as the radius of the rotation trajectory of the substantially circular shape drawn by the rear part of the rotation table frame 5. The rotation table frame 5 has the left and right width substantially matching the left and right width of the crawler traveling device 3, and is configured to be rotatable by the drive of the rotary motor 6 arranged in the vicinity of the opening 5*a* on the crawler traveling device 3.

The front part of the rotation table frame 5 is cut to a straight line in the left and the right direction so that the outer peripheral shape has a linear shape. A boom bracket attachment part 5*b* for attaching the boom bracket 15 configured to a substantially triangular shape in plan view is arranged so as to project towards the front side at the middle in the left and the right direction of the linear part, and is arranged so that the boom bracket 15 for attaching the working machine 1 is positioned within the rotation radius at the front part of the boom bracket attachment part 5*b*. The drive operation unit 13 is arranged on the left side of the rotation table frame 5, the bonnet 10 is arranged on the right side and the rear part so as to lie along the outer peripheral shape of the rotation table frame 5, and the engine 8, the hydraulic pump 26, the fuel tank, the hydraulic fluid tank, the radiator and the like are accommodated in the bonnet.

Furthermore, a step difference part 5*c* depressed towards the rear side is arranged on either the left or the right side at the front part of the rotation table frame 5, or in the present example, the right side which is on the symmetrically opposite side with respect to the drive operation unit 13. The front surface of the step difference part 5*c* extends in the left and right direction. An opening 10*a* is formed on the upper side of the front surface of the step difference part 5*c*, and a swing cylinder 28 is arranged so as to project towards the boom bracket 15 from the opening 10*a*. The swing cylinder 28 has the rear end pivotally supported in a freely turning manner by a pivot supporting part 5*d* arranged on the rotation table frame 5 and the front end connected to the boom bracket 15, so that the boom bracket 15 can turn to the left and the right with respect to the rotation table frame 5 by the extension drive.

Furthermore, a second step 29 is arranged on the upper side of the step difference part 5*c* of the rotation table frame 5 so as to hide the step difference part 5*c* and the opening 10*a* and cover the upper front part of a cylinder tube of the swing cylinder 28, and to be positioned within the rotation radius. The second step 29 having a substantially triangular shape in plan view is detachably fixed to the front part of the bonnet 10, and is arranged so that the height of the upper surface coincides continuously in the left and right direction with the step 12 arranged at the front part of the drive operation unit 13. A walk through space opening in the left and right direction is thereby formed on the upper side of the step 12 and the second step 29, whereby a workable range in the main equipment 2 is enlarged by the walk through space and workability is improved. The hydraulic hose is collectively extended towards each cylinder 20, 21, 22 arranged in the working machine 1 from the opening 10*a* on the lower side of the second step 29, whereby maintenance is easily carried out by removing the second step 29.

On the rotation table frame 5 covered with the bonnet 10, a supporting body integrally configured with an engine support member 31 for supporting the engine 8 arranged in the left and right direction on the rotation table frame 5 and a canopy installation member 32 for installing the canopy 14 is fixedly arranged on the rotation table frame 5, as shown in FIG. 6 to FIG. 9. The supporting body is configured to a substantially L-shape in plan view.

Figure 9:
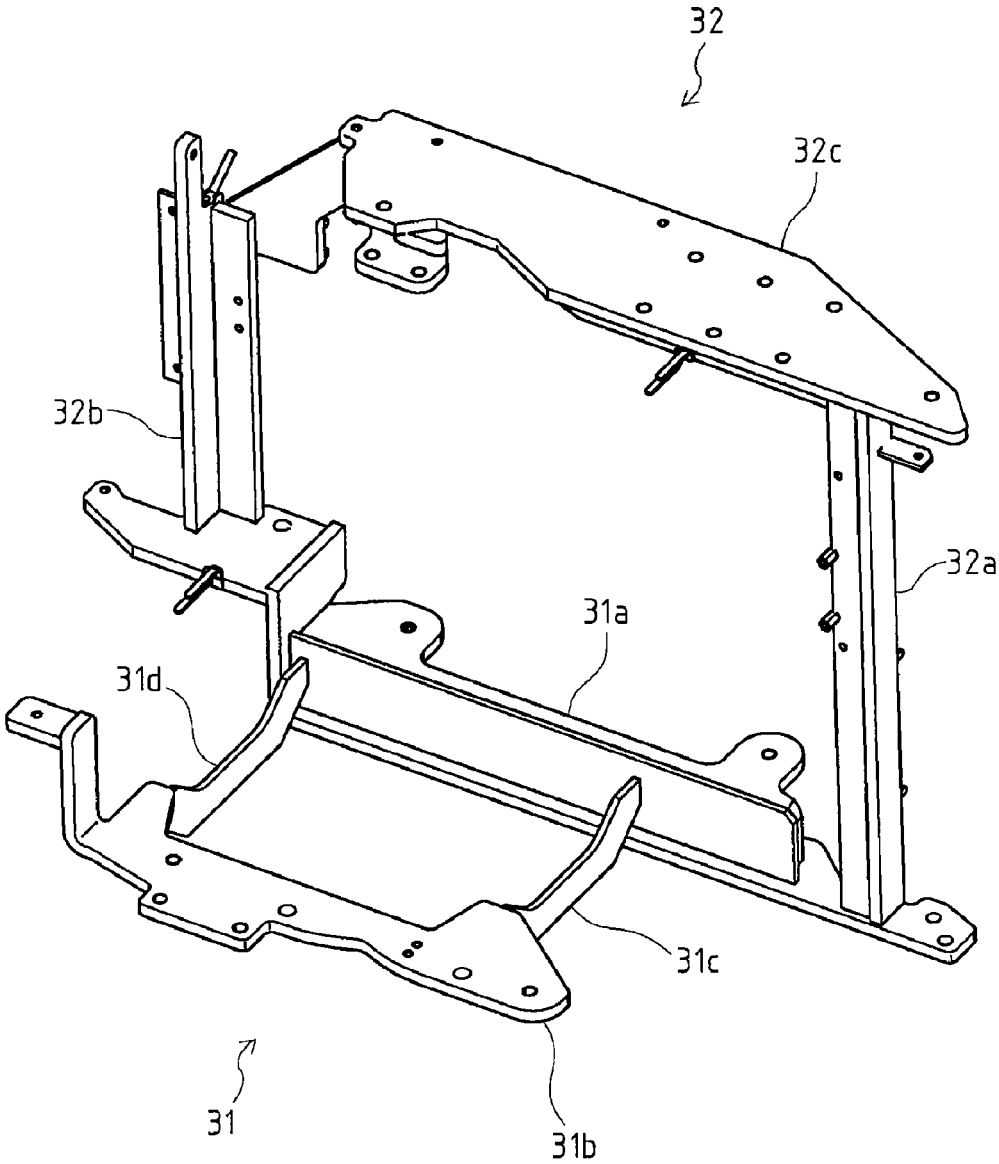
FIG. 9 is a perspective view of the engine supporting part.

As shown in FIG. 9, the engine support member 31 includes a back frame 31*a* and a front frame 31*b* arranged parallel on the front and the back in the left and right direction, and frames 31*c*, 31*d* arranged parallel on the left and the right in the front and back direction, where the frames 31*a*, 31*b*, 31*c*, 31*d* are arranged in a horizontal direction and configure a frame shape. The back frame 31*a* is directly fixed and arranged on the rotation table frame 5, and the front frame 31*b* is fixedly arranged on the rotation table frame 5 by way of a bracket 33 folded to a reverse U-shape in side view. The left and right frames 31*c* and 31*d* configured to a ship bottom shape in side view are transversely arranged at an appropriate spacing between the back frame 31*a* and the front frame 31*b*. The engine 8 is supported on the back frame 31*a* and the front frame 31*b* of the engine support member 31 by way of a vibration absorption member 34, and the canopy installation member 32 is raised at the back frame 31*a*.

The canopy installation member 32 includes column shaped left and right frames 32*a*, 32*b* and a plate shaped canopy installation plate 32*c*, where the left and right frames 32*a*, 32*b* are fixedly arranged so as to project to the upper side from both left and right sides of the back frame 31*a* of the engine support member 31, and the canopy installation plate 32*c* is transversely arranged between the upper ends of the left and right frames 32*a*, 32*b*. The canopy installation member 32 is thereby integrally formed with the engine support member 31 and fixed on the rotation table frame 5 with a bolt etc., and thus tilt or vibration in the front and back direction can be reduced compared to when fixedly arranged on the rotation table frame 5 alone. That is, since a heavy engine is mounted on the engine support member 31, the canopy installation member 32 is less likely to tilt towards the rear side and the tilt towards the front side is inhibited by the engine support member 31, and thus is stably supported on the rotation table frame 5. The canopy installation plate 32*c* is arranged on the rear side of the driver's seat 11 of the drive operation unit 13, and the canopy 14 is attached and fixed on the canopy installation plate 32*c*.

Furthermore a reinforcement member 35 is connected between the upper part of the canopy installation member 32 and the front part of the engine support member 31 to reinforce the supporting body. That is, the reinforcement member 35 is configured by forming the plate to a substantially reverse L-shape in side view, arranged so as to surround the upper front side of the engine 8, connected to the front frame 31*b* of the engine support member 31 at the lower part of a vertical part 35*a*, and connected to the canopy installation plate 32*c* of the canopy installation member 32 at the rear part of a horizontal part 35*b*. The canopy installation member 32 and the engine support member 31 are formed to a frame shape in side view and firmly fixed by the reinforcement member 35.

Thus, the canopy installation member 32 and the engine support member 31 are integrally fixed on the rotation table frame 5, and the canopy installation member 32 can be firmly fixed and stabilized compared to when the canopy installation member 32 is fixed alone on the rotation table frame 5. The canopy installation member 32 and the engine support member 31 can be assembled to the rotation table frame 5 with various equipments attached to the canopy installation member 32 and the engine support member 31, whereby the assembling performance as a module can be improved.

Equipment to be attached to a supporting body integrally configured by the canopy installation member 32 and the engine support member 31 includes a battery 36, an air cleaner 37, a radiator 40, and the like. The battery 36 is supported and fixed on a battery mounting base 38 attached to the left frame 32*a* of the canopy installation member 32, and is arranged on the rear side of the upper left part of the engine 8. The air cleaner 37 is attached to the bottom surface of the canopy installation plate 32*c* by way of a stay 39 and the like, and is arranged on the upper rear side of the middle part in the left and right direction of the engine 8. The radiator 40 is supported on a radiator supporting base 41 attached to the right end of the back frame 31*a* and the front frame 31*b* of the engine support member 31, and is arranged on the right side of the engine 8. The hydraulic hose and harness are additionally attached to the canopy installation member 32, so that vibration and entanglement are prevented.

A muffler 42 is attached to the reinforcement member 35. The muffler 42 is attached by way of a stay 43 attached to the horizontal part 35*b* of the reinforcement member 35, and is arranged in the front and back direction at the upper side of the engine 8. As various equipments can be attached to the supporting body, the engine 8 is attached to the supporting body and then various equipments such as the battery 36 or the air cleaner 37, the radiator 40, and the muffler 42 are attached to the canopy installation member 32 and the reinforcement member 35 from the front and back and left and right periphery of the engine before attaching to the rotation table frame 5, whereby an assembly task can be performed with tools and hands brought closer to each part, and the assembly task can be reliably and easily performed.

Figure 7:
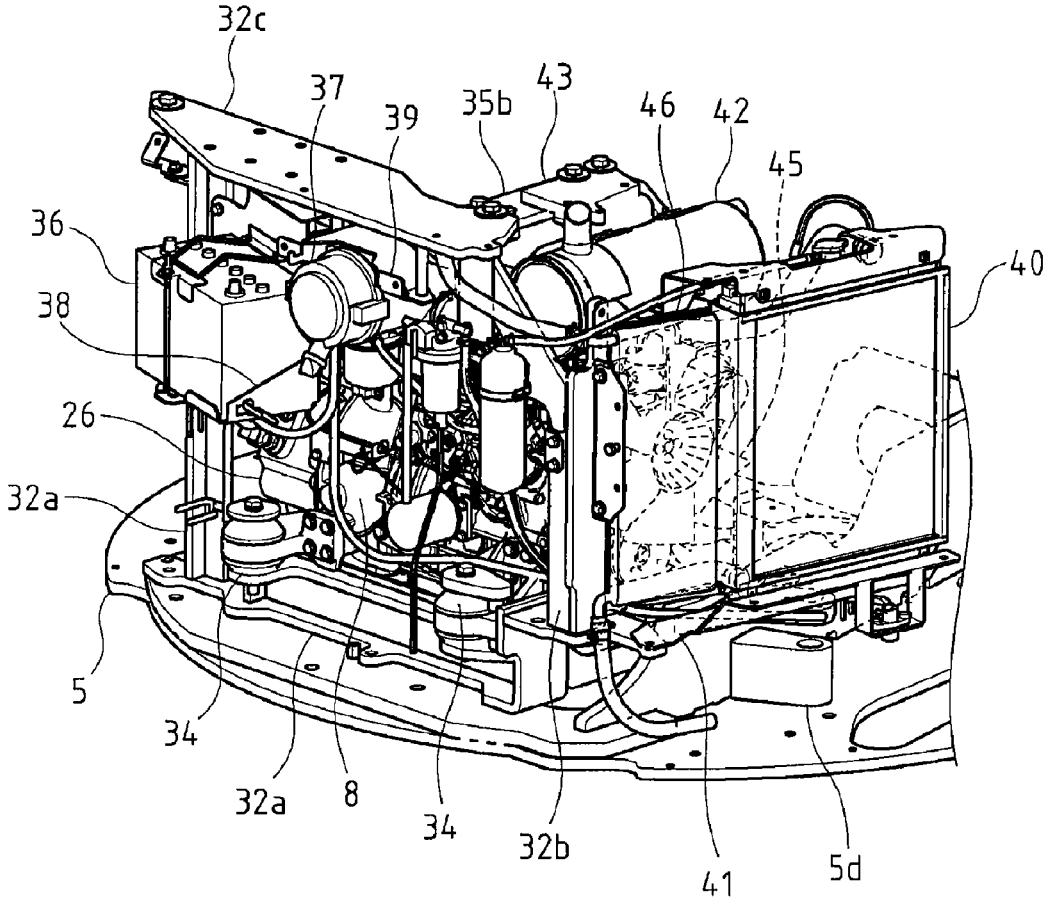
FIG. 7 is a rear perspective view of the engine supporting part.
Figure 8:
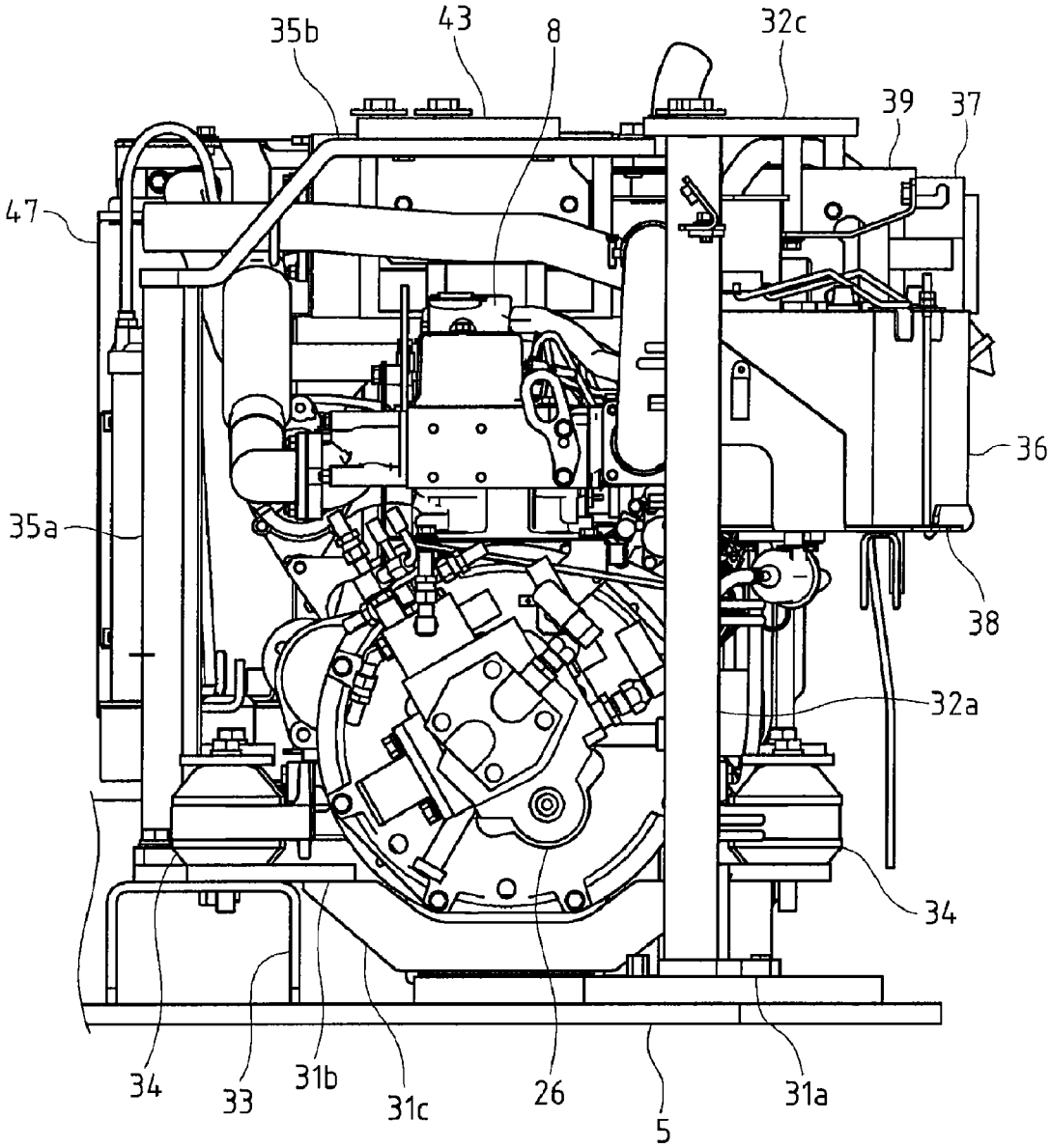
FIG. 8 is a left side view of the engine supporting part.

As shown in FIG. 3, the engine 8 supported on the engine support member 31 is arranged so that a crank shaft lies in the left and right direction of the equipment body. A cooling fan 45 is arranged on the right side of the engine 8, and is drivable through a belt and a pulley by the engine 8. As shown in FIG. 7, the radiator 40 and the oil cooler 46 are continuously arranged in the front and the back direction on the right side of the cooling fan 45, and are arranged so as to be lined without overlapping in side view and so that the front end faces the outer direction. A shroud 47 is arranged between the radiator 40 and oil cooler 46 and the cooling fan 45, and a substantially triangular space is formed in plan view in the shroud 47. The cooling airflow produced by the rotation of the cooling fan 45 thereby passes through a space in the shroud 47 and simultaneously hits the radiator 40 and the oil cooler 46 to cool the same.

Figure 10:
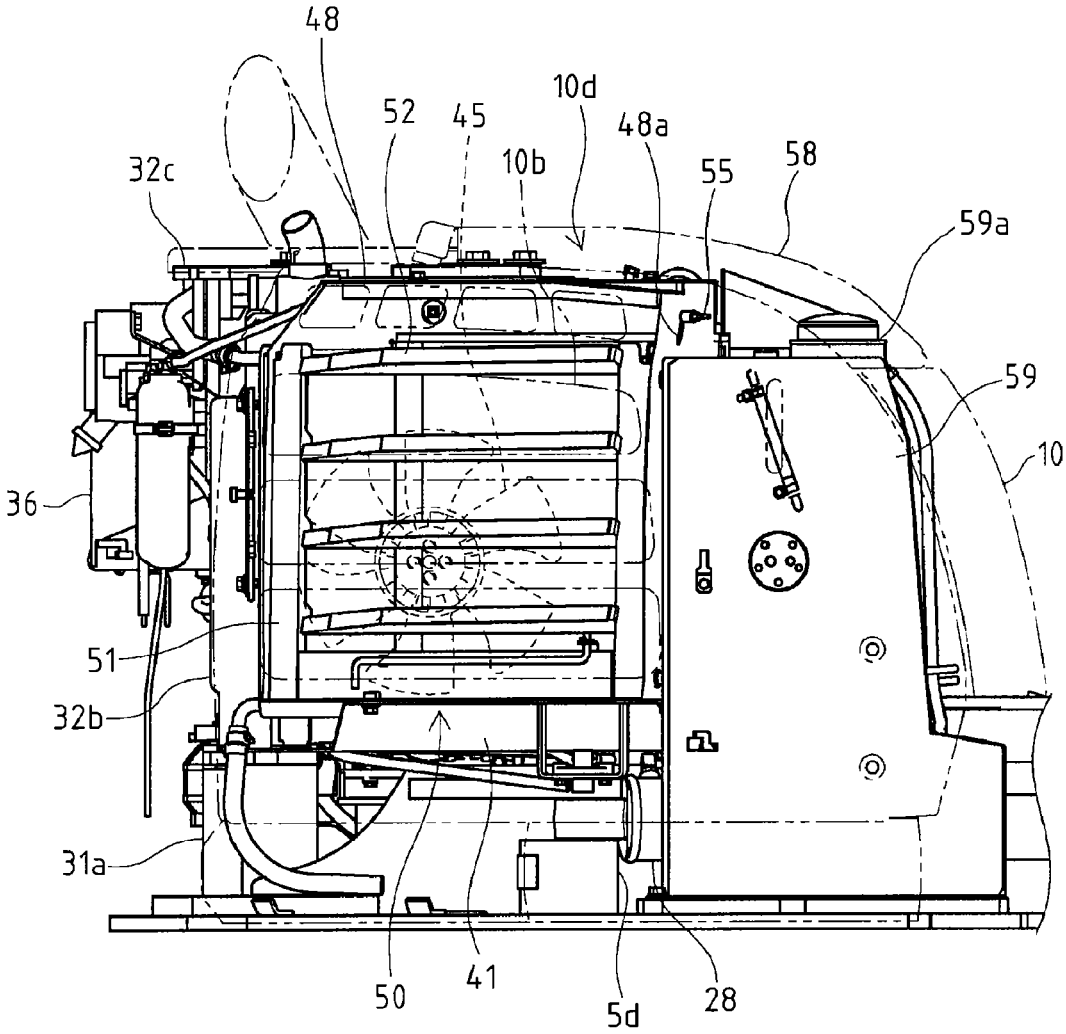
FIG. 10 is a right side view showing an arrangement structure of the rotation table frame.

As shown in FIG. 2 and FIG. 10, the radiator 40 and the oil cooler 46 are arranged with a predetermined spacing from the side wall of the bonnet 10 formed to a circular arc shape, and a duct 48 is arranged between the radiator 40 and oil cooler 46 and the side wall of the bonnet 10. An opening 10*b* is formed at a portion facing the radiator 40 and the oil cooler 46 at the side surface of the bonnet 10, so that the duct 48 communicates with the outside through the opening 10*b*, and the cooling airflow from the cooling fan 45 can be discharged to the outside from the duct 48 and the opening 10*b*. A cross rail 10*c* is bridged parallel in the up and down direction at the opening 10*b* and a mesh form member is arranged, whereby protection of the radiator 40 and the oil cooler 46 is achieved by the cross rail 10*c* and the mesh form member.

A movable louver 50 is arranged in the duct 48 between the radiator 40 and oil cooler 46 and the opening 10*b* formed at the side surface of the bonnet 10, so that the airflow direction of the cooling airflow can be changed when the cooling airflow from the cooling fan 45 is discharged to the outside from the opening 10*b* by the louver 50.

Figure 11:
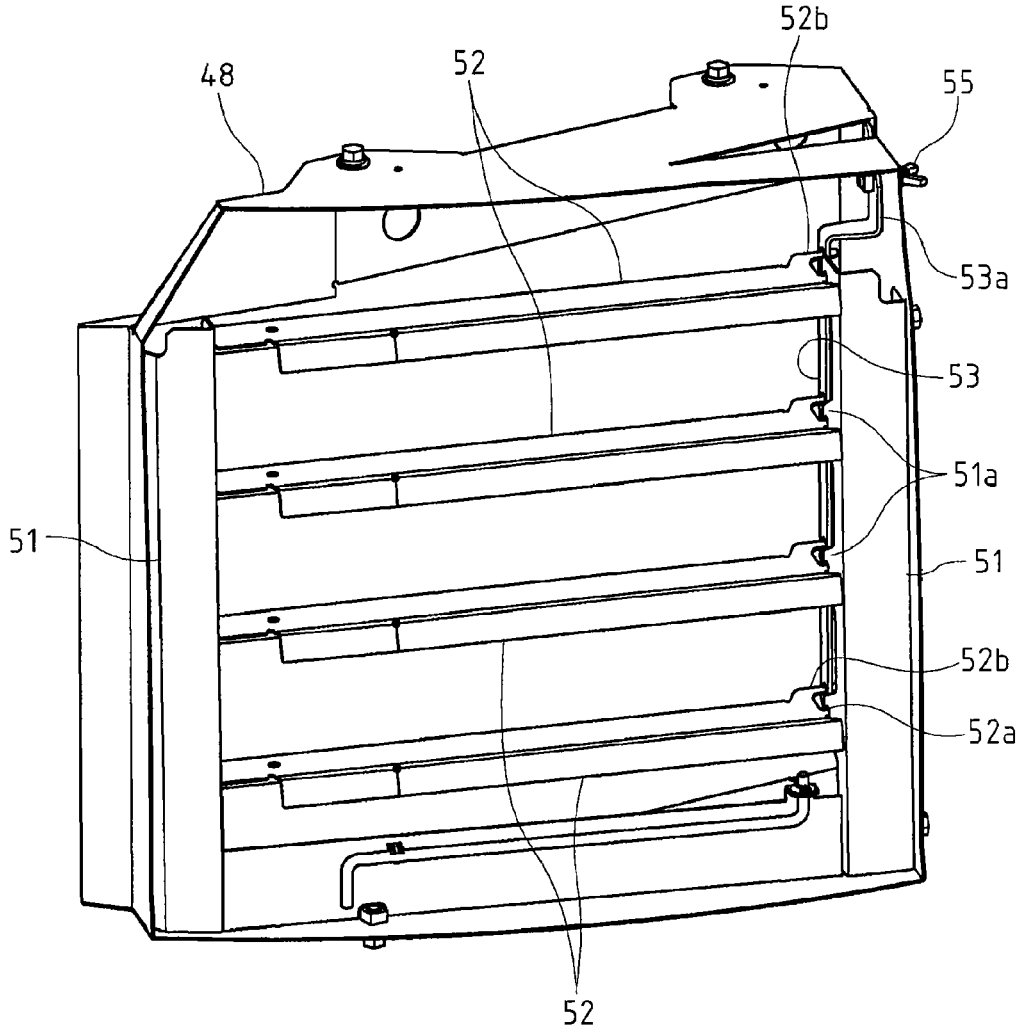
FIG. 11 is a side view of a louver.
Figure 12:
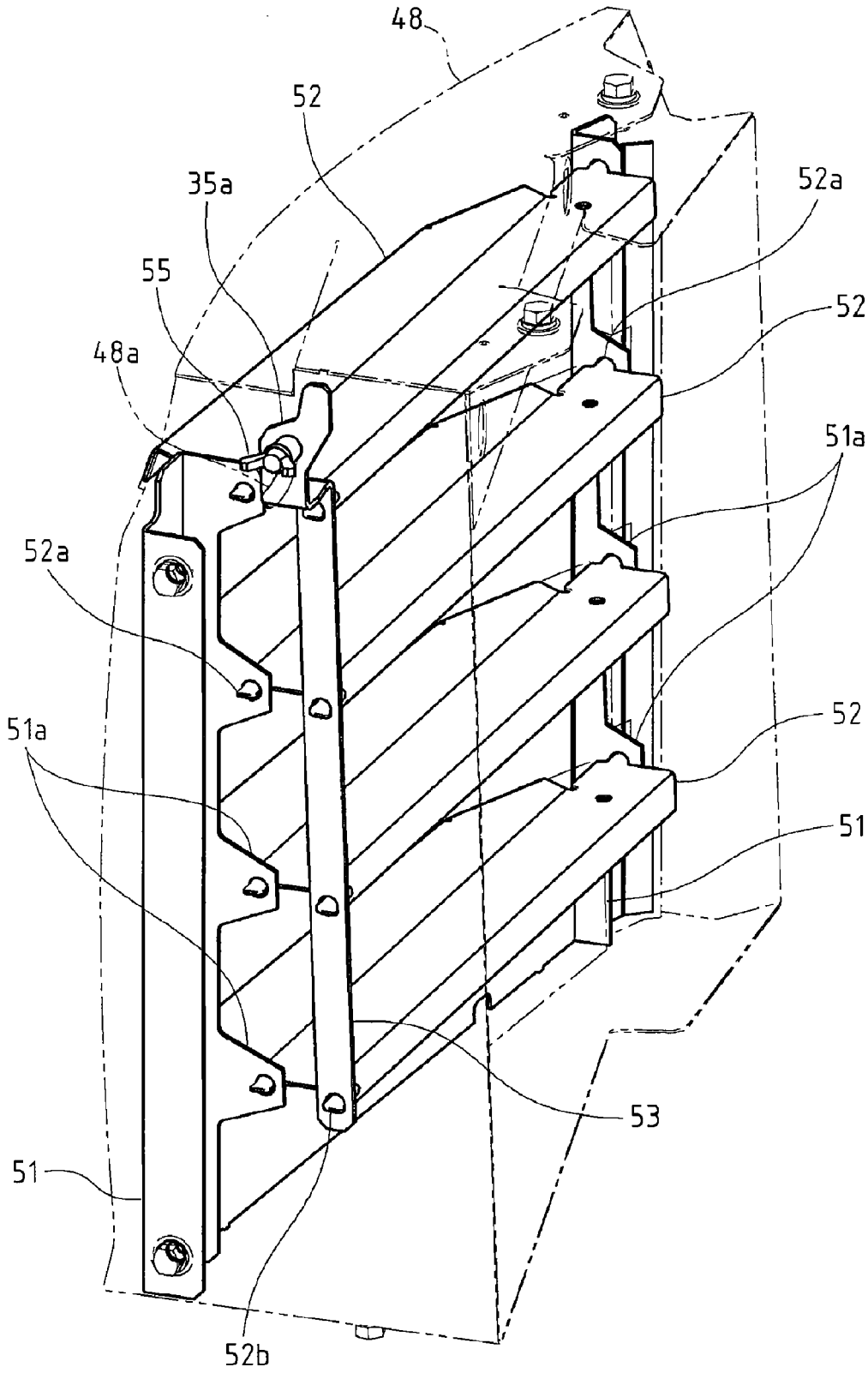
FIG. 12 is a perspective view of the louver.

As shown in FIG. 11 and FIG. 12, the louver 50 is configured from a pair of front and back side frames 51 fixedly arranged on the side wall of the duct 48; blades 52 arranged in plural in the up and down direction between the side frames 51; a means for changing the angle of the blades 52; and a position fixing member of the angle. The blades 52 are bridged parallel in the up and down direction, and formed with shaft parts 52*a* projecting towards the side frames 51 from one end in the short side direction at both ends in the longitudinal direction of each blade 52. The shaft parts 52*a* are pivotally supported by bearing parts 51*a* arranged at a predetermined spacing in the up and down direction of each left and right side frames 51. The louver 50 is movably configured by supporting both sides of each blade 52 in a turning manner with the left and right side frames 51. The blade 52 has the outer side bent slightly towards the diagonally upward side, where the portion facing the oil cooler 46 has a narrow width and has a shape that lies along the side wall of the bonnet 10.

A pivotally supporting part 52*b* is arranged in a projecting manner parallel to the shaft part 52*a* from the other end in the short side direction at one end in the longitudinal direction of each blade 52, and the pivotally supporting part 52*b* is pivotally supported by a lever 53 arranged in the up and down direction parallel to the side frame 51. The lever 53 is then connected to the blades 52 so that the blades 52 can be turned in the same direction by moving the lever 53 in the up and down direction. The upper part of the lever 53 is extended to the upper side of the duct 48, and the upper end part 53*a* thereof is bent so as to contact the side wall of the duct 48. The position fixing member is arranged between the upper part of the lever 53 and the duct 48. That is, a bolt is projected to the side from the upper end part 53*a* of the lever 53.

A circular arc shaped long hole 48*a* is formed in the side wall of the duct 48 on the side of the upper end part 53*a* of the lever 53, the bolt is projected to the outside from the long hole 48*a*, a butterfly nut 55 is screw attached, and the butterfly nut 55 is tightened so that the lever 53 can be fixed at an arbitrary position to which it has been operated. The louver 50 thus can change and hold the blades 52 at an arbitrary angle. The fixing means of the lever 53 is not limited to a bolt and a nut, and may be a pin and the like, or the motor may be coupled to one of the shaft parts 52*a* to change the angle of the blades 52, with the motor, or the lever 53 may be coupled to a cylinder to change the angle of the blades 52, by extending the cylinder. Remote operation may be performed with an operation means in which an actuator such as motor or cylinder is arranged in the operation unit.

The louver 50 is thus configured to hold the blades 52 at an arbitrary angle by operating the lever 53 from above the duct 48. A state in which the outer side of the blade 52 is inclined and held towards the diagonally upper side when the nut 55 is positioned and tightened at the upper end of the long hole 48*a* formed in the side wall of the duct 48 to have the lever 53 at the upper most position is obtained, or the blade 52 may be held at a substantially horizontal state when the nut 55 is positioned and tightened at the lower end of the long hole 48*a* to fix the lever at the lower most position. The nut 55 can be positioned and fixed at an arbitrary position in the up and down direction of the long hole 48*a*.

Therefore, after the radiator 40 and the oil cooler 46 are cooled by the cooling airflow produced by the rotation of the cooling fan 45, the cooling airflow is discharged from the opening 10*b* formed in the bonnet 10, but the discharging direction of the cooling airflow can be angularly changed to the side or to the diagonally upper side of the main equipment according to the situation. Thus, the warmed cooling airflow is prevented from blowing against trees and walkers. For instance, if there are trees on the side of the main equipment, the cooling airflow can be discharged so as not to blow against the trees by changing the discharging direction of the cooling airflow to the diagonally upper side of the main equipment. The warmed cooling airflow sometimes blows against the operator on the drive operation unit 13 depending on the airflow direction when discharged to the upper side. In such case, the cooling airflow can be discharged to the side by being changed to a substantially horizontal direction, thereby preventing the warmed cooling airflow from blowing against the operator.

The nut 55 for adjusting the louver 50 is arranged on the lower side of the cover 58 covering the maintenance space 10*d* arranged on the front right part of the bonnet 10, as shown in FIG. 10. The cover 58 has the rear end pivotally supported by the equipment body, and is configured to turn in the up and down direction with the rear end as the center to be opened and closed. When the cover 58 is turned upward and opened, the nut 55 is exposed so that the nut 55 can be operated, whereby the angle adjustment of the blades 52 of the louver 50 can be easily and rapidly performed.

Figure 13:
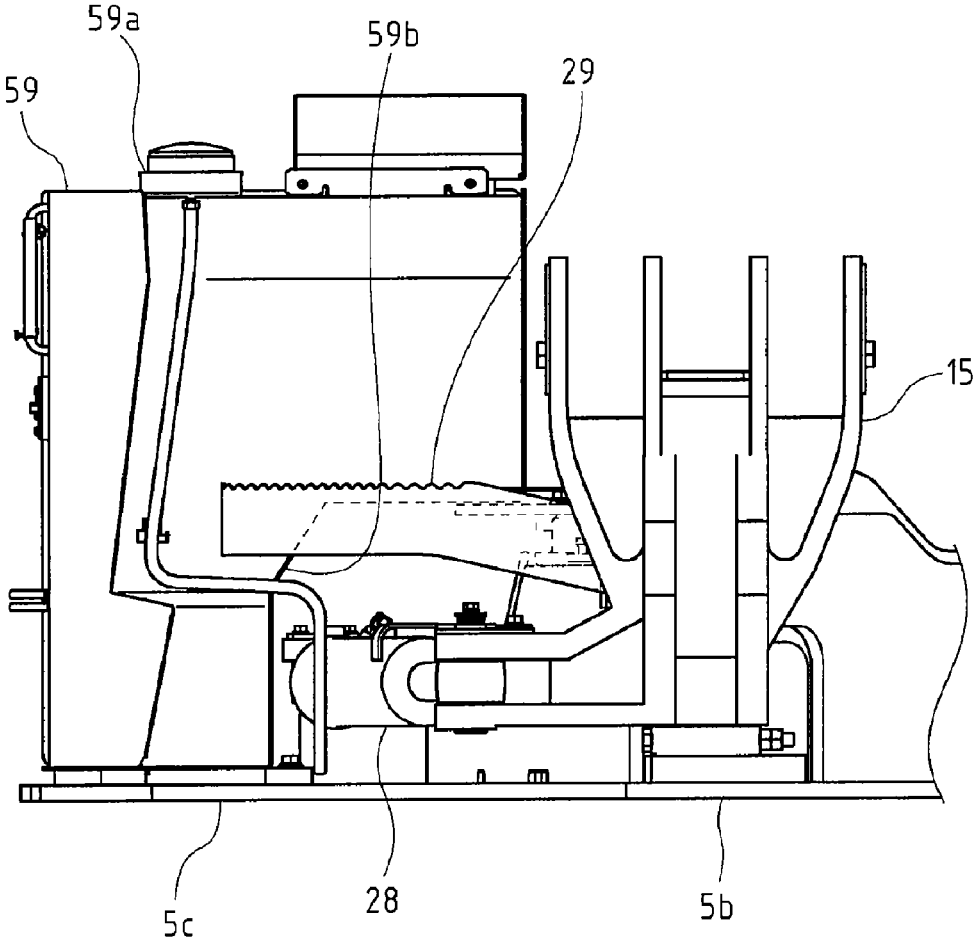
FIG. 13 is a front view showing an arrangement structure of the right side of a front part of the rotation table frame.

A fuel tank 59 is arranged on the front side of the radiator 40 and the louver 50. As shown in FIG. 10 and FIG. 13, the fuel tank 59 is mounted and fixed on the rotation table frame 5, and the upper part is covered with the cover 58. An oil supply port 59*a* is formed in the upper surface of the fuel tank 59, where the cover 58 is turned upward to be opened, so that oil can be supplied to the fuel tank 59 from the oil supply port 59*a*. The inner side in the left and right direction of the equipment body at the lower part of the fuel tank 59 has a cutout shape, and the swing cylinder 28 is arranged in the cutout part 59*b*. The fuel tank 59 has the lower end bulging out towards the side of the swing cylinder 28 to enlarge the capacity, and is arranged on the same left or right side of the swing cylinder 28 and the rotation table frame 5. A reservoir tank may be similarly configured and arranged in place of the fuel tank 59.

The second step 29 is arranged on the front side of the fuel tank 59, so that the worker can turn and open the cover 58 on the second step 29 to perform angle adjustment of the blade 52 of the louver 50 and to supply oil from the oil supply port 59*a* to the fuel tank 59.

The hydraulic pump 26 is arranged on the symmetrically opposite side with respect to the radiator 40 of the engine 8, and is drivable by the engine 8. As shown in FIG. 3, a reservoir tank 61 is arranged on the left side of the hydraulic pump 26, and the control valve 25 is arranged on the front side of the reservoir tank 61. The control valve 25 and the hydraulic pump 26, the reservoir tank 61 and control valve 25 and the rotary motor 6, the swing cylinder 28, and each cylinder 20, 21, 22 of the working machine 1 are connected with the hydraulic hose, and the hydraulic oil is supplied from the reservoir tank 61.

Figure 14:
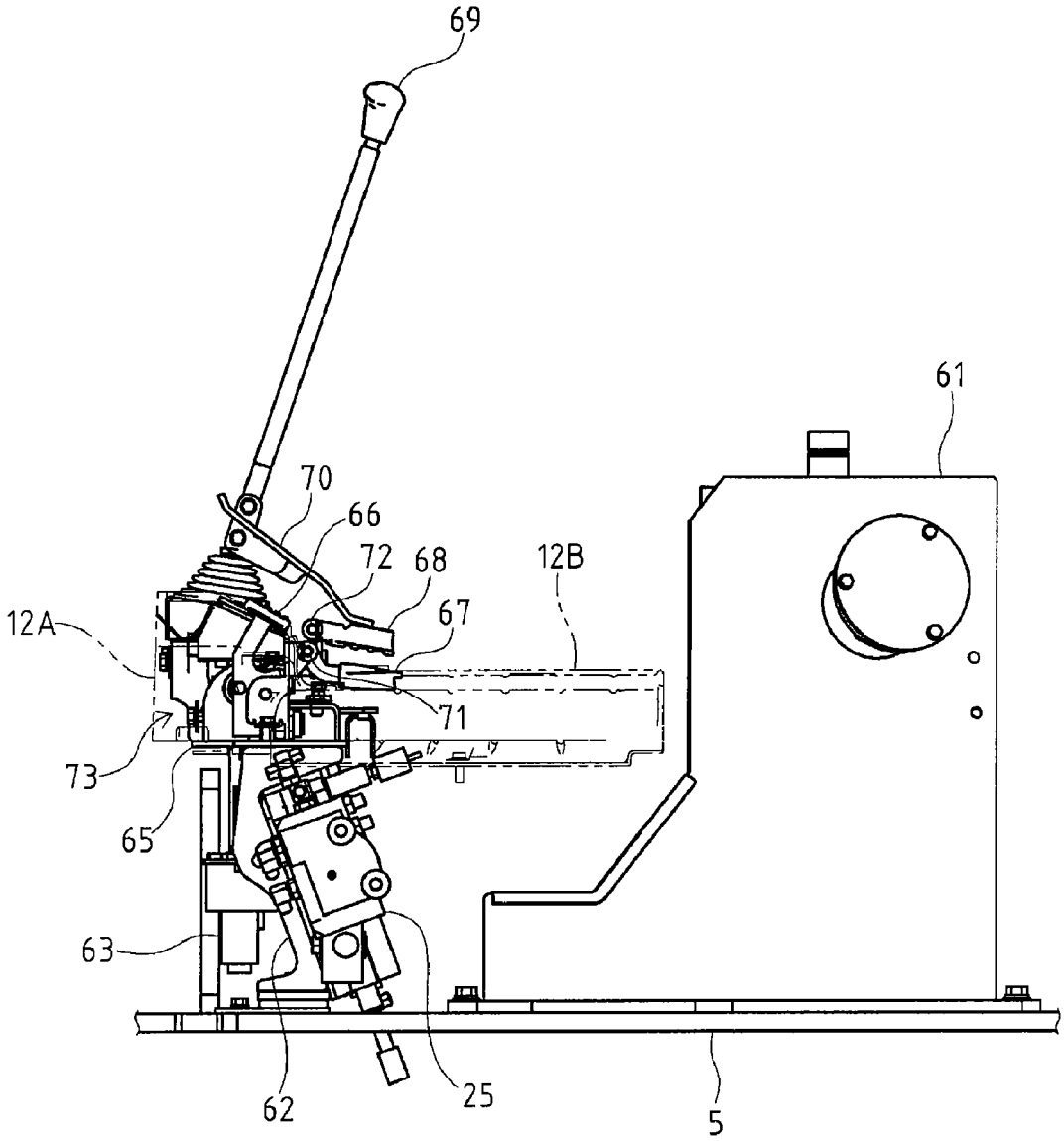
FIG. 14 is a left side view showing the arrangement structure of the rotation table frame.
Figure 15:
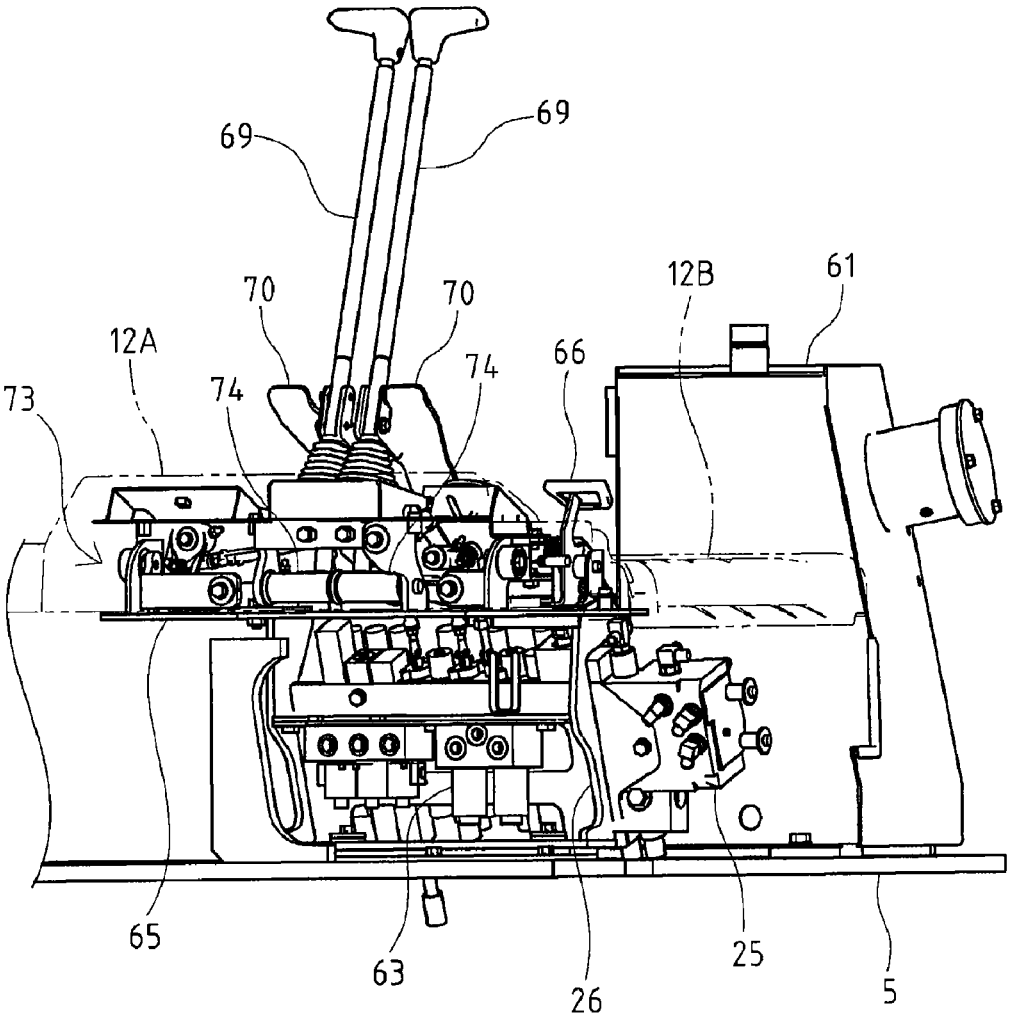
FIG. 15 is a perspective view showing the arrangement structure of the left side of the front part of the rotation table frame.

As shown in FIGS. 14 and 15, the control valve 25 is arranged on the front left part of the rotation table frame 5 at the front side of the reservoir tank 61, and the bracket 62 is held and fixed in a state raised in an inclined manner so as to be high on the front side and low on the rear side. Since the control valve 25 is arranged in an inclined manner, it can be arranged on the front side of the rotation table frame 5 as much as possible, and the rear end position of the control valve 25 can be positioned on the front side. The space on the rear side can be formed large, the front part of the reservoir tank 61 can be arranged in a bulging out manner in the relevant space, and the capacity of the reservoir tank 61 can be enlarged. An external take-out component 63 for a breaker and the like which serves as a post-attachment working machine can be arranged in a space formed on the lower front side of the control valve 25.

A pedal base 65 is arranged on the upper end of the bracket 62 attached with the control valve 25, and the step 12 is arranged on the upper side of the pedal base 65. The step 12 includes a front step 12A covering the pedal base 65 and a back step 12B connected to the rear part of the step 12A, where a plurality of pedals and levers is arranged on the front step 12A or the back step 12B. In this case, a travel speed increasing pedal 66, a PTO operation pedal 67, and a swing pedal 68 are arranged lined in order from the left near the middle at the front part of the step 12, and a pair of left and right travel operation levers 69 are arranged between the PTO operation pedal 67 and the swing pedal 68 so as to project to the upper side. Operation pedals 70 are integrally arranged at the lower part of each left and right operation lever 69, so that the operation levers 69 can be operated with the operation pedals 70.

Figure 16:
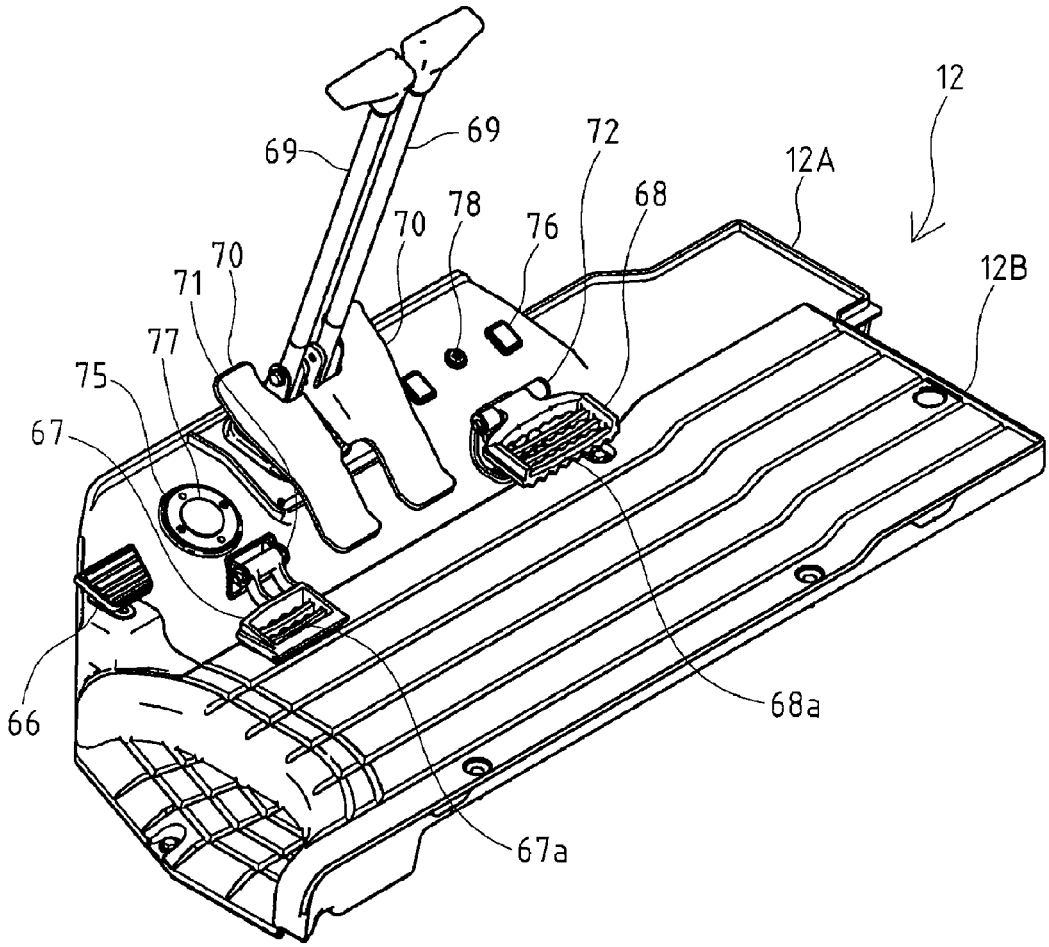
FIG. 16 is a perspective view showing a step part in a pedal operation state.
Figure 17:
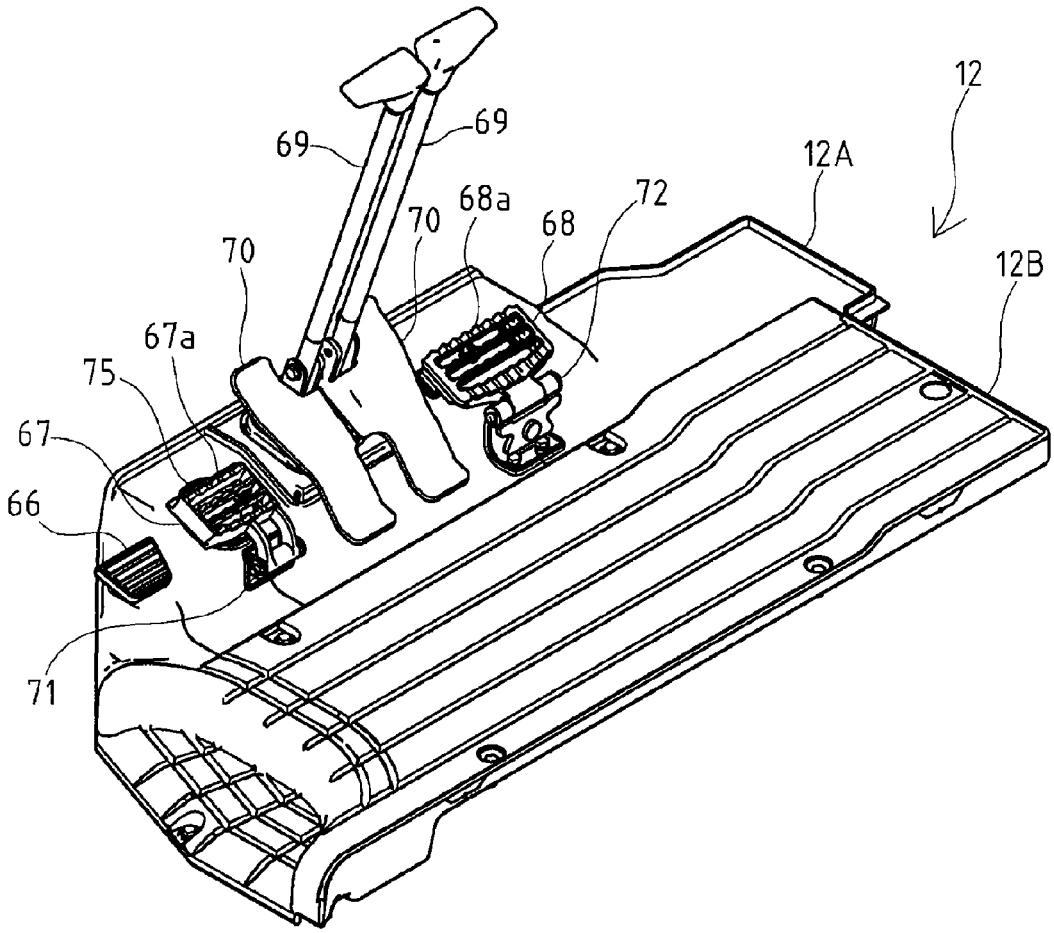
FIG. 17 is a perspective view of the step part in a pedal accommodating state.
Figure 18:
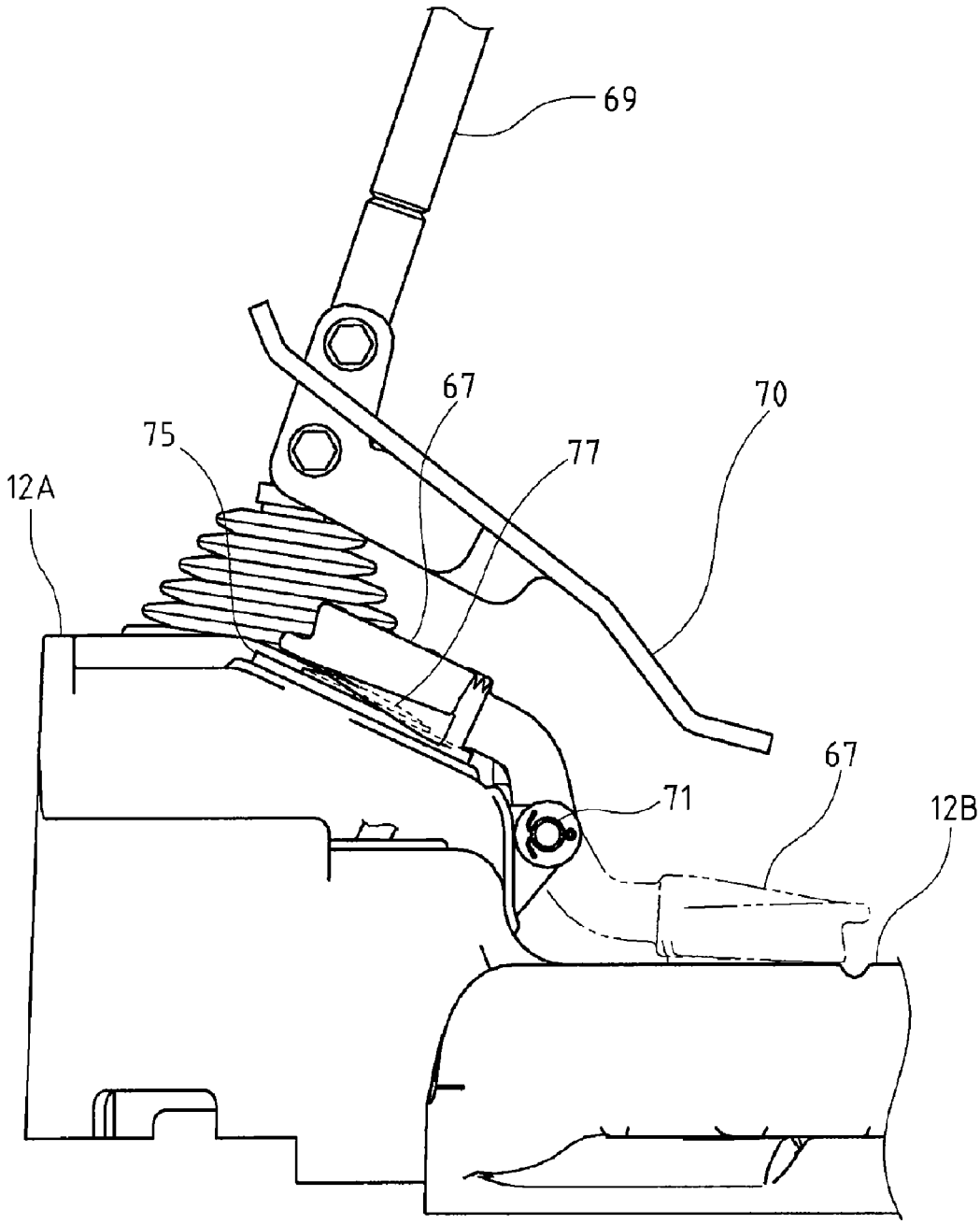
FIG. 18 is a side view of a pedal supporting part.

As shown in FIGS. 16 to 18, the PTO operation pedal 67 and the swing pedal 68 are supported in a freely front and back turning manner with the supporting point axes 71, 72 as the center at the pedal base 65 on one side (front side), and are connected to the control valve 25 by way of a link mechanism 73 arranged on the pedal base 65. Similarly, the operation levers 69 are supported in a freely front and back turning manner with the supporting point axes 74 as the center, and are connected to the control valve 25 by way of the link mechanism 73 arranged on the pedal base 65. Since the control valve 25 is arranged in a diagonally inclined manlier with the front side high and the rear side low as described above, the distance between the upper end of the control valve 25 and the operation lever 69 or the operation pedal 70 is shorter than when arranged horizontally as in the prior art, whereby the link mechanism 73 for connecting the components has a simple structure, and the cost can be reduced. The operation pedals 70 can be stably pushed down and operated.

The PTO operation pedal 67 and the swing pedal 68 are formed into a substantially L-shape in side view, one side being arranged with foot placing parts 67*a*, 68*a* at both upper and lower surfaces and the other end being pivotally supported at the supporting point axes 71, 72, and are configured to be switchable between an operation state of being push-down operable by the turning in the front and back direction and a non-operable accommodating state (foot rest state). As shown in FIG. 16, each pedal 67, 68 is turned towards the rear side until positioned on the back step 12B and becomes an operable state when contacting the operation member of the hydraulic actuator in the link mechanism 73, and as shown in FIG. 17, turned towards the front side up to the front step 12A and becomes a non-operable accommodating state when contacting a receiving member 75, 76 exposed on the step 12A to be in the foot rest state.

Each pedal 67, 68 is formed such that the middle of the placing part 67*a*, 68*a* is depressed downward in the operation state, where when the foot is placed on the placing part 67*a*, 68*a* and pressed down, the pedal turns in the up and down direction with the supporting point axes 71, 72 as the center, whereby the control valve 25 is operated through the link mechanism 73. The swing pedal 68 is operated by being swung to the left and the right. When switched from the operable state to the accommodating state by hand and turned towards the front side, the receiving member 75, 76 is contacted at both left and right sides, and held on the front step 12A. Option switches 77, 78 are arranged at the middle of the receiving members 75, 76 so as to be covered by the upwardly convex placing parts 67*a*, 68*a* of the pedals 67, 68 when the pedals 67, 68 are accommodated.

When the operation of the PTO operation pedal 67 to the swing pedal 68 is not necessary in such structure, the pedal 67, 68 is turned toward the front side with the supporting point axis 71, 72 as the center to contact the receiving member 75 of the front step 12A, whereby the push-down operation of the pedal 67, 68 is disabled and false operation is prevented. At the same time, the option switches 77, 78 are covered by the placing parts 67*a*, 68*a* of the pedals 67, 68, and false operation thereof is also prevented. The lower surface of the placing parts 67*a*, 68*a* of the pedals 67, 68 can also be used as a foot rest, whereby the space for the foot portion of the operator at the step 12 can be efficiently used.

When operation of the PTO operation pedal 67 or the swing pedal 68 becomes necessary, the pedal 67, 68 is turned towards the rear side with the supporting point axis 71, 72 as the center and arranged on the back step 12B, so that push-down operation becomes possible. Therefore, if pedals 67, 68 are not necessary, the pedals 67, 68 themselves are turned towards the front side from the back step 12B and easily accommodated in the front step 12A, and the space for the foot portion of the operator at the step 12 can be enlarged. Since the non-operable state can be maintained by simply turning the pedals 67, 68 towards the front side, a pedal cover that disables the pedal as in the prior art is not necessary, and the number of components can be reduced.

Figure 19:
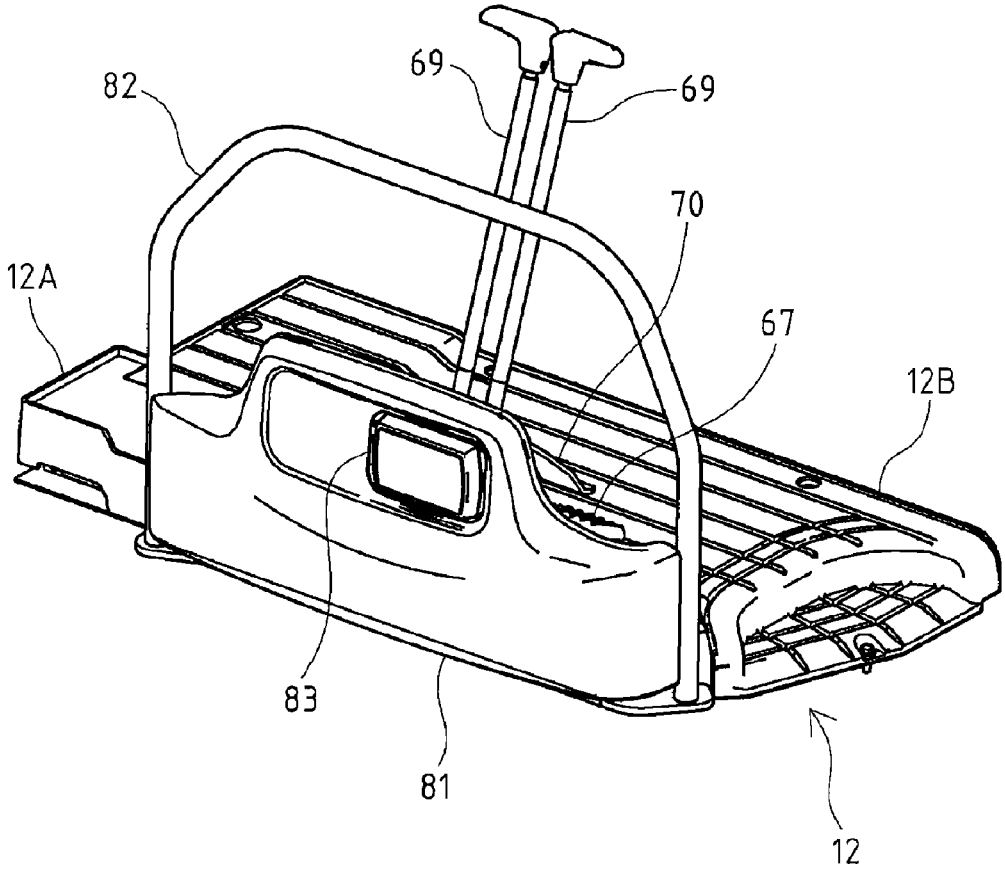
FIG. 19 is a perspective view of a front cover.
Figure 20:
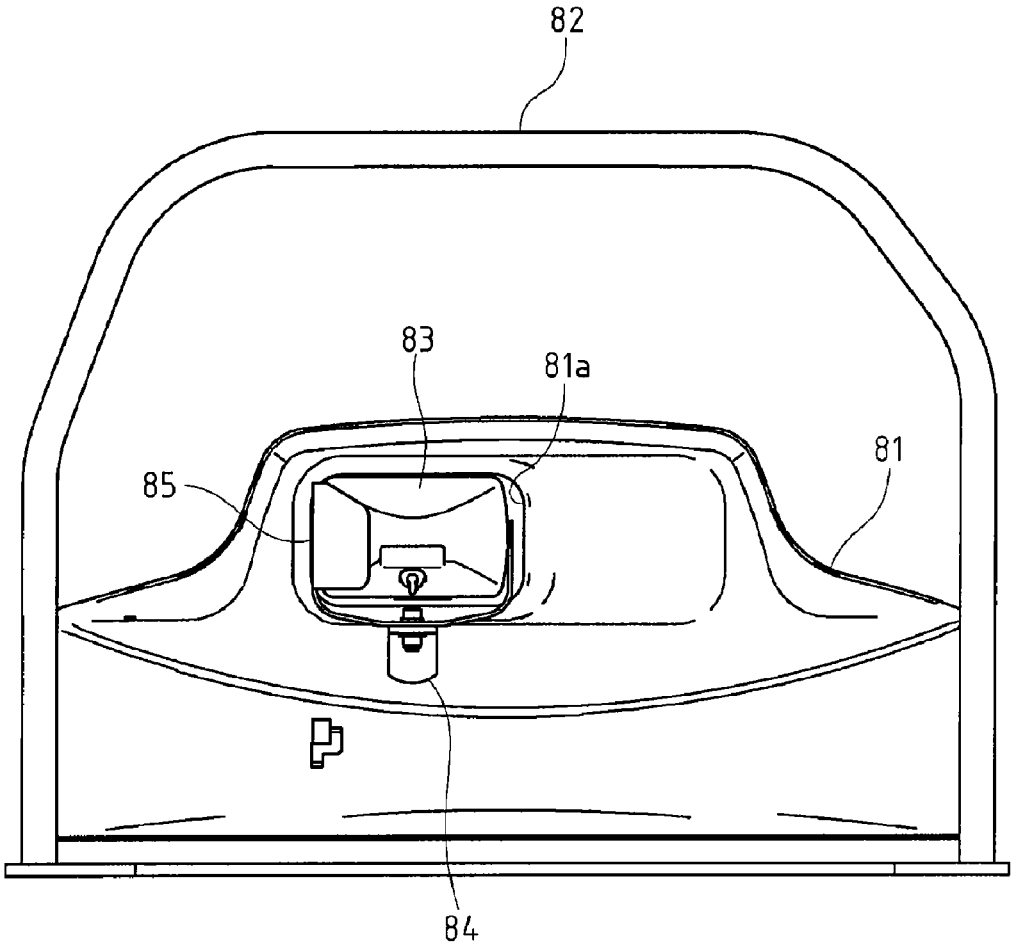
FIG. 20 is a rear view of the front cover.
Figure 21:
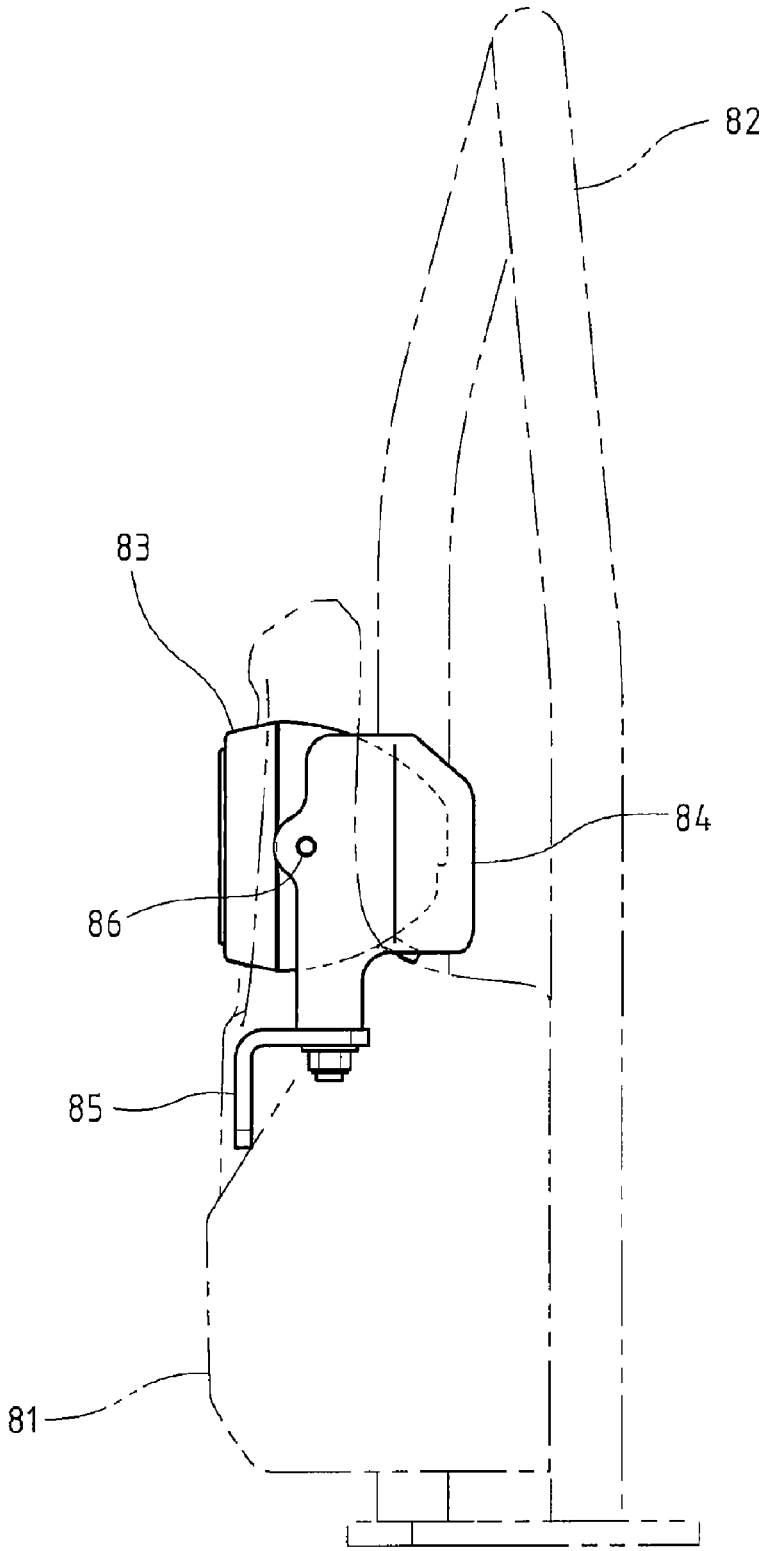
FIG. 21 is a side view showing a supporting structure of a front lamp.

As shown in FIG. 2, the front cover 81 is arranged at the front end part of the step 12 so as to cover the front side of the PTO operation pedal 67, the swing pedal 68 and the like. As shown in FIG. 19 to FIG. 21, the front cover 81 is formed to a convex form in front view, and is transversely arranged between a handrail 82 of a substantially gate shape in front view arranged in an upstanding manner at the front part of the step 12. An opening 81*a* is formed at the upper part at the middle of the front cover 81, and a front lamp 83 is arranged in the opening 81*a* so as to be at a high as possible position at the front side of the drive operation unit 13. Thus, the front side of the operator can be lighted by the front lamp 83, which improves the surrounding visibility.

The front cover 81 is arranged such that the upper part of both left and right sides are positioned on the front side of the pedals 67, 68 arranged on both left and right sides of the step 12. Thus, when stretching the leg towards the front side of the pedal, the legs can be stretched towards the front side from both left and right sides of the front cover 81, thereby enlarging the space of the foot portion of the operator.

Figure 22:
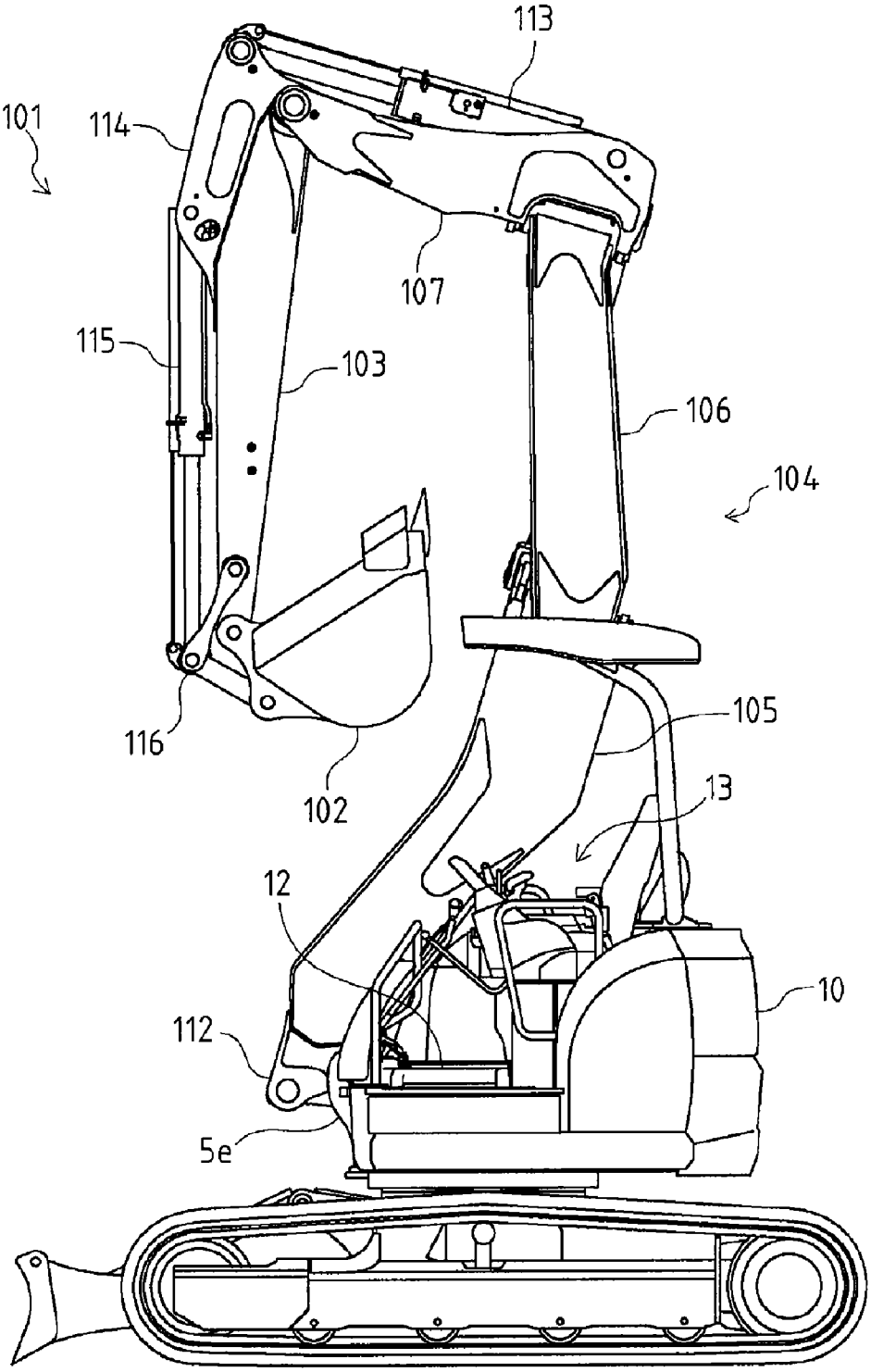
FIG. 22 is a left side view of an ultraminiature rotary type rotary working machine according to one example of the present invention.

The rotation table frame 5 including the engine 8, the hydraulic pump 26, the fuel tank, the hydraulic oil tank, the radiator, and the like is arranged with an attachment part at the middle in the left and right direction of a line extending in the left and right direction of the front part thereof to attach the working machine 1, so that the rotary working machine of a rear ultraminiature rotary type is obtained, but an attachment part may be arranged at the step difference part 5*c* formed on the right side of the front part to attach the working machine, so that the rotary working machine of an ultraminiature rotary type is obtained, as shown in FIG. 22. That is, the rear ultraminiature rotary type and the ultraminiature rotary type rotary working machine have a common shape other than the front end of the rotation table frame 5, and thus can be commonly used. Therefore, the molding die of the rotation table frame 5 in the rear ultraminiature rotary type and the ultraminiature rotary type rotary working machine can be shared, which enhances productivity and reduces cost.

Figure 23:
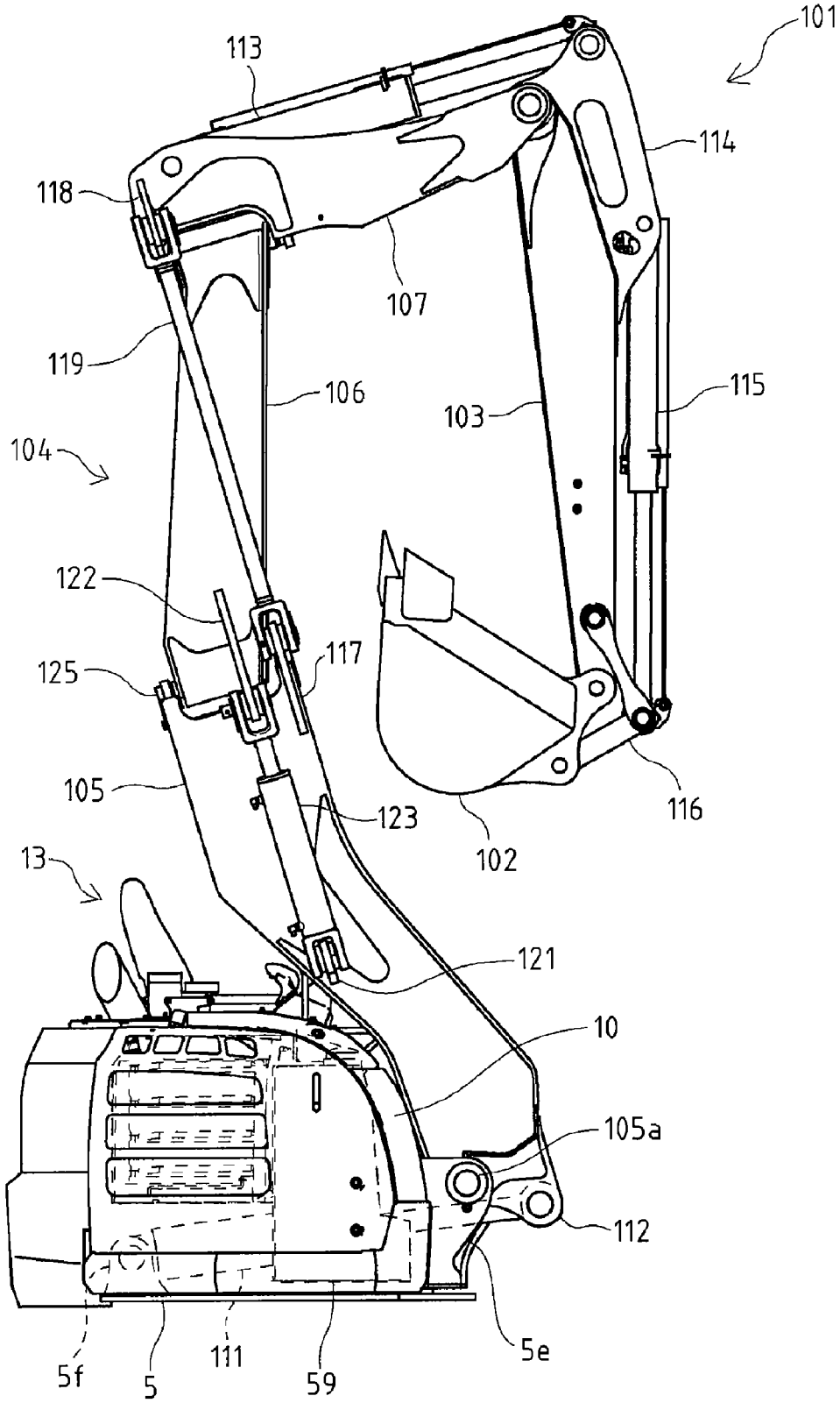
FIG. 23 is a right side view of an upper part of the ultraminiature rotary type rotary working machine.
Figure 24:
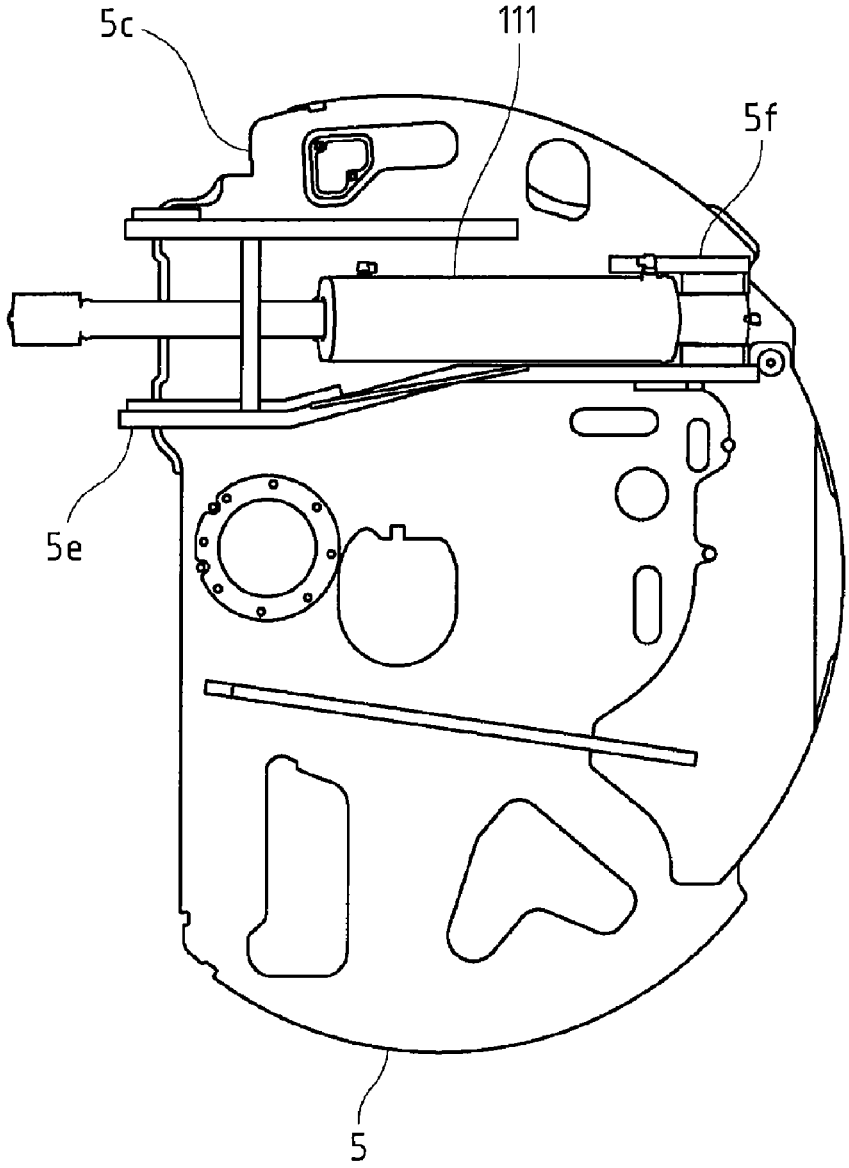
FIG. 24 is a plan view of the rotation table frame.

As shown in FIG. 23 and FIG. 24, when the ultraminiature rotary type rotary working machine is configured using such rotation table frame 5, the working machine 101 is pivotally supported by a pivotally supporting part 5*e* at the step difference part 5*c* of the rotation table frame 5 so that the supporting point 105*a* is positioned within the rotary radius, and is arranged closer to the right side with respect to the rotation table frame 5. The space of the drive operation unit 13 arranged on symmetrically opposite side of the working machine is ensured as wide as possible, and the comfortability of the drive operation unit 13 improves.

Figure 25:
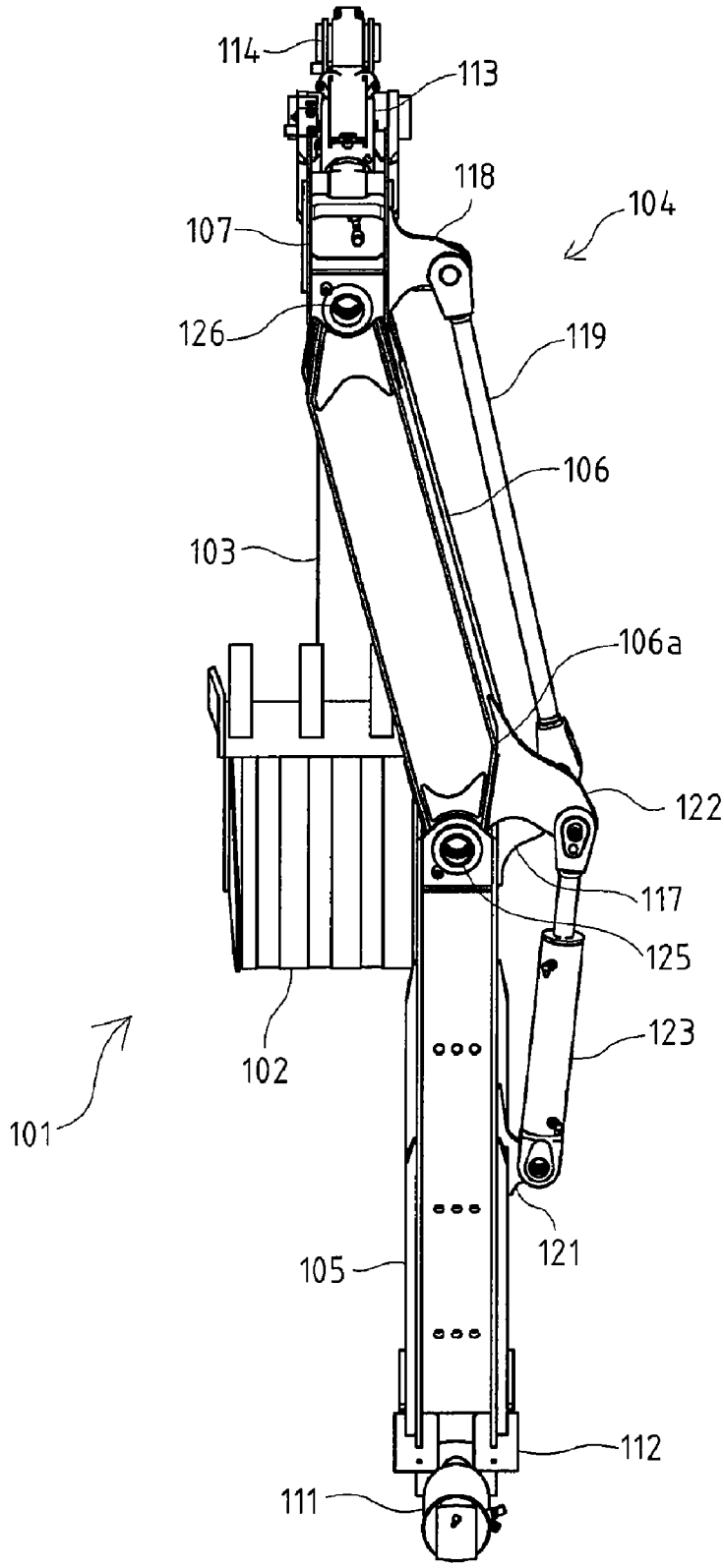
FIG. 25 is a rear view of the offset type working machine.

As shown in FIG. 23 and FIG. 25, the working machine 101 includes a bucket 102, an arm 103, a boom 104, and a hydraulic cylinder for operating the same, and is configured as an offset type working machine in which the bucket 102 serving as an attachment is movable in the left and right direction with respect to the boom 104. The boom 104 has, from the basal side, a first boom 105, a second boom 106, and a third boom 107 connected in order towards distal end side from the main equipment side, where the base part of the first boom 105 is pivotally supported in an up and down (front and back) turning manner by the pivotally supporting part 5*e* on the step difference part 5*c* of the rotation table frame 5, the base part of the second boom 106 is pivotally supported in a left and right turning manner at the distal end of the first boom 105, and the base part of the third boom 107 is pivotally supported in a left and right turning manner at the distal end of the second boom 106. The base part of the arm 103 is pivotally supported in an up and down turning manner at the distal end of the boom 104, that is, the distal end of the third boom 107, and the bucket 102 is pivotally supported in a front and back turning manner at the distal end of the arm 103.

A boom turning boom cylinder 111 is interposed between the bracket 112 arranged projecting downward from a supporting point 105*a* at the base part of the first boom 105 and a pivotally supporting part 5*f* arranged at the rear part of the rotation table frame 5; an arm turning arm cylinder 113 is interposed between the arm bracket 114 arranged projecting upward from the base part of the arm 103 and the base part of the third boom 107; and a bucket turning bucket cylinder 115 is interposed between the link mechanism 116 of the bucket 102 and the arm bracket 114. The boom 104 then can be turned by the extension drive of the boom cylinder 111, the arm 103 can be turned by the extension drive of the arm cylinder 113, and the bucket 102 can be turned by the extension drive of the bucket cylinder 115.

An offset rod 119 is interposed between the bracket 117 arranged projecting to the right side surface on the distal end side of the first boom 105 and the bracket 118 projecting to the right side surface on the base part side of the third boom 107, and an offset cylinder 123 is interposed between the bracket 121 arranged projecting to the right side surface at the middle of the first boom 105 and the bracket 122 arranged projecting to the right side surface of the base part of the second boom 106. In this manner, the second boom 106 turns to the left and the right when the offset cylinder 123 is extension driven, the offset rod 109 also turns to the left and the right in conjunction with the turning of the second boom 106, and the third boom 107, the arm 103, and the bucket 102 arranged at the distal end side from the third boom 107 substantially parallel move (offset movement) to the left and the right without tilting to the left or the right in rear view.

Figure 26:
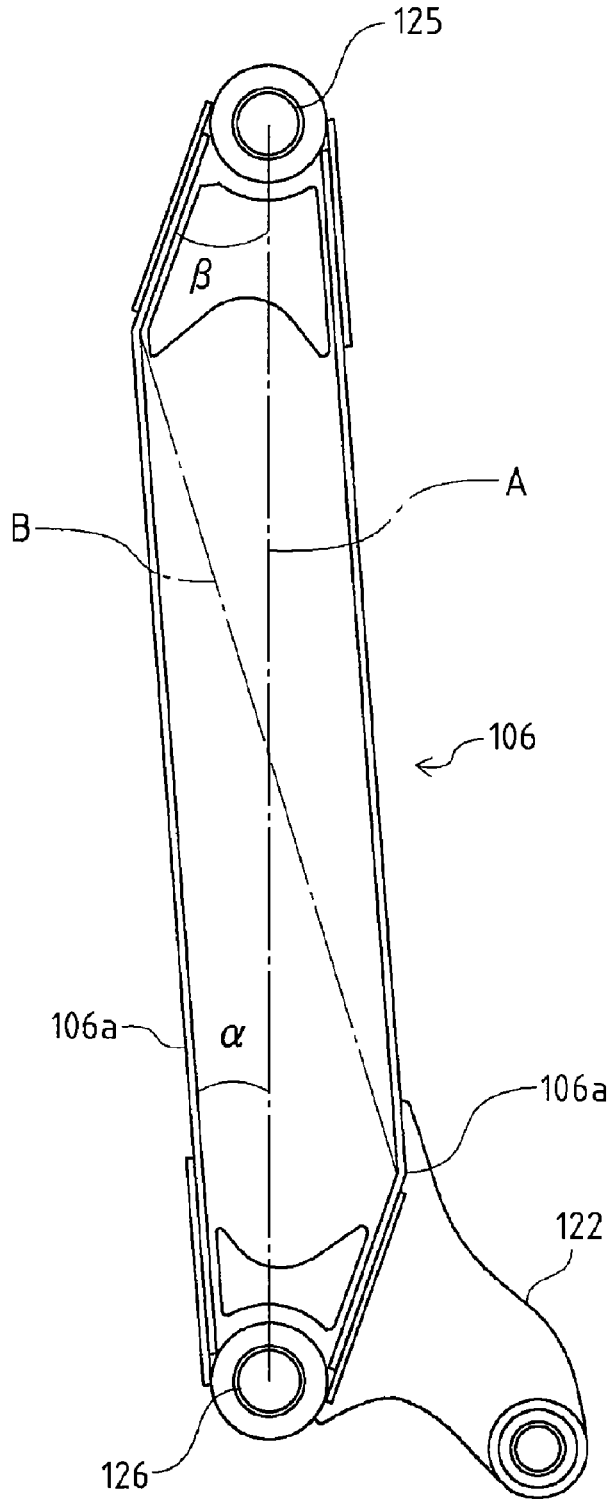
FIG. 26 is a rear view of a second boom.

As shown in FIG. 26, the second boom 106 is formed to a substantially parallelogram shape in rear view with the boom 104 turned to the most rear side, where one diagonal line A is arranged in the up and down direction, the other diagonal line B is arranged slanted to the middle side in the left and right direction of the equipment body, and the first boom 105 and the third boom 107 are respectively pivotally supported by the pivot supporting shaft 125, 126 arranged on both ends of the former diagonal line A. In other words, assuming the second boom 106 has a substantially parallelogram shape, the angle $\alpha$ between the diagonal line A in the front and back direction (up and down direction) and the side 106*b* of the base part side on the inner side of the equipment body is smaller than the angle $\beta$ between the diagonal line A and the side 106*c* of the distal end side on the inner side of the equipment body.

Accordingly, the projection on the inner side of the base part becomes small without lowering the rigidity of the second boom 106 and thus is less likely to contact the inner side of the distal end part of the first boom 105, and the second boom 106 can be greatly turned to the inner side of the main equipment body. Since the offset amount of the second boom 106 can be increased, the first boom 105 can be arranged on the outer side of the equipment body as much as possible, and the space of the drive operation unit 13 can be enlarged. In this case, since the portion 106*a* bulging out towards the outer side of the base part side of the second boom 106 is greater than the bulging to the inner side at the same upper and lower positions, the bracket 122 which is the pivotally supporting part of the piston rod of the offset cylinder 123 for turning the second boom 106 can be arranged further projecting to the outer side at the portion 106*a* projecting to the outer side of the base part side of the second boom 106, and thus the second boom 106 can be greatly turned to the inner side of the main equipment.

Furthermore, the first boom 105 is formed to a substantially S-shape in side view. The first boom 105 is configured such that the bucket 102 enters the space formed on the distal end side and at the same time so that the front part of the bonnet 10 enters the rear space formed on the base part side when the working machine 101 is at the most rear side position and the bucket 102 is turned to approach the boom 104 through the arm 103. Accordingly, the bucket 102 can be positioned on the main equipment side on the rear side as much as possible without increasing the turning angle to the rear side of the first boom 105, that is, the working machine 101, and the rotary radius can be made small.

As shown in FIG. 23, the boom cylinder 111 for turning the boom 104 is accommodated in the bonnet 10 at the rear side of the step difference part 5*c* of the rotation table frame 5, and is arranged so as to be positioned on the lower side from the step 12 arranged in the drive operation unit 13. The wide space in the bonnet 10 is ensured, the capacity of the fuel tank 59, the reservoir tank 61, and the like to be accommodated in the space can be increased or the space through which the cooling airflow flows can be reliably ensured. Miniaturization and lighter weight of the working machine 101 can be achieved by arranging the boom cylinder 111 on the main equipment side instead of the working machine 101 side.

In the ultraminiature rotary type rotary working machine including the offset type working machine 101 described above, the boom cylinder 111 is arranged at substantially the same position as the swing cylinder 28 of the rear ultraminiature rotary type rotary working machine on the rotation table frame 5, and the fuel tank 59 and the radiator 40 are arranged lined in the front and the back direction on the upper side of the boom cylinder 111 on the rotation table frame 5 similar to above, and the engine 8 and the reservoir tank 61 are arranged side by side at the side of the radiator 40. Various equipments are thus efficiently arranged on the rotation table frame 5, where the layout is configured to be shared between the rear ultraminiature rotary type and the ultraminiature rotary type rotary working machine.

INDUSTRIAL APPLICABILITY

The rotary working machine of the present invention ensures a wide space on the front side and the back side on the control valve at the rotating table frame, and is industrially effective.

The invention claimed is:

1. A rotary working machine comprising:

a rotating table frame;

a step arranged at a front part of the rotating table frame;

a PTO operation pedal arranged near a middle front part of the step;

a swing pedal arranged near the middle front part of the step;

a pair of left and right travel operation levers arranged between the PTO operation pedal and the swing pedal so as to project upwardly;

a bracket arranged at the front part of the rotating table frame;

a control valve mounted to the bracket and operably connected to the travel operation levers, the PTO operation pedal and the swing pedal, and wherein the control valve is configured to perform drive control of a hydraulic actuator; and a pedal base arranged on an upper end of the bracket, wherein the control valve is arranged to be inclined with respect to the rotating table frame at a lower side of the step so that a first end of the control valve is higher than a second end of the control valve, wherein the PTO operation pedal, the swing pedal and the travel operation levers are each supported in a freely front and back turning manner by a supporting point axis, and wherein the PTO operation pedal, the swing pedal and the travel operation levers are operably connected to the control valve by way of a link mechanism arranged on the pedal base.

2. The rotary working machine according to claim 1, wherein a reservoir tank is arranged on the second side of the control valve.

* * * * *